US011539165B2

(12) United States Patent
Sato

(10) Patent No.: US 11,539,165 B2
(45) Date of Patent: Dec. 27, 2022

(54) LEVER-TYPE CONNECTOR

(71) Applicant: Yazaki Corporation, Tokyo (JP)

(72) Inventor: Takahiko Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/232,654

(22) Filed: Apr. 16, 2021

(65) Prior Publication Data

US 2021/0336389 A1 Oct. 28, 2021

(30) Foreign Application Priority Data

Apr. 24, 2020 (JP) ..... JP2020-077006

(51) Int. Cl.
*H01R 13/62* (2006.01)
*H01R 13/629* (2006.01)
*H01R 13/428* (2006.01)

(52) U.S. Cl.
CPC ..... *H01R 13/62955* (2013.01); *H01R 13/428* (2013.01)

(58) Field of Classification Search
CPC ..... H01R 13/6295; H01R 13/62955
See application file for complete search history.

(56) References Cited

U.S. PATENT DOCUMENTS

| | | | | |
|---|---|---|---|---|
| 9,281,614 | B1 * | 3/2016 | Bonucci | H01R 13/62927 |
| 2006/0211286 | A1 | 9/2006 | Shuey | |
| 2007/0197071 | A1 | 8/2007 | Patterson | |
| 2018/0301850 | A1 | 10/2018 | Hirota | |

FOREIGN PATENT DOCUMENTS

| | | | |
|---|---|---|---|
| JP | 2008-533684 | A | 8/2008 |
| JP | 2010-146950 | A | 7/2010 |
| JP | 2010-160942 | A | 7/2010 |
| JP | 2018-181625 | A | 11/2018 |
| WO | 2021/197881 | A1 | 10/2021 |

* cited by examiner

*Primary Examiner* — Ross N Gushi
(74) *Attorney, Agent, or Firm* — Sughrue Mion, PLLC

(57) ABSTRACT

Between a housing and a position ensuring member, provided are: a first locking mechanism that locks move of the position ensuring member at a standby position in an ensuring-operation direction toward a fitting assured position when a lever member is not at a completely fitted position; and a second locking mechanism that locks move of the position ensuring member at the fitting ensured position in an ensuring-release direction that is a reverse direction of the ensuring-operation direction when the lever member is at the completely fitted position. Between the lever member and the position ensuring member, provided is a locking release mechanism that releases a locked state of the position ensuring member with the first locking mechanism when the lever member comes at the completely fitted position.

12 Claims, 20 Drawing Sheets

LEVER-TYPE CONNECTOR

CROSS-REFERENCE TO RELATED APPLICATION(S)

The present application claims priority to and incorporates by reference the entire contents of Japanese Patent Application No. 2020-077006 filed in Japan on Apr. 24, 2020.

BACKGROUND OF THE INVENTION

1. Field of the Invention

The present invention relates to a lever-type connector.

2. Description of the Related Art

Conventionally, fitting connectors such as a female connector and a male connector fitted and connected mutually are used for electrically connecting two items. Each of the connectors in a completely fitted state where the connectors are fitted into a specified fitting position is in an energizable state, while those are in a non-energizable state when not fitted into the specified fitting position. Thus, for making it possible to determine whether each of the connectors is in a completely fitted state, there is a type of fitting connector provided with a position ensuring member that is operable only in a completely fitted state. Meanwhile, also known as a fitting connector is a lever-type connector in which a rotatable lever member is attached to a housing of one of connectors such that a fitting operation force or a removal operation force between each of the connectors is decreased by a rotational operation of the lever member. For example, a lever-type connector with a position ensuring member is disclosed in Japanese Patent Application Laid-open No. 2010-146950, Japanese Patent Application Laid-open No. 2010-160942, and Japanese Patent Application Laid-open No. 2008-533684.

Incidentally, with such a lever-type connector with a position ensuring member, after the connectors are fitted and connected to a specified fitting position by the lever member, the position ensuring member is moved from a standby position that is not in a completely fitted state to a fitting ensured position that is in a completely fitted state. At that time, for moving the position ensuring member to the fitting ensured position, it is necessary to release a locked state of the position ensuring member at the standby position after fitting and connecting each of the connectors. As described, in terms of fitting/connecting work of each of the connectors, there is room for improvement in the operability of this kind of lever-type connector.

SUMMARY OF THE INVENTION

It is therefore an object of the present invention to provide a lever-type connector suitable for fitting/connecting work.

In order to achieve the above mentioned object, a lever-type connector according to one aspect of the present invention includes a housing that is relatively movable along connector insertion/removal directions between a temporarily fitted state and a completely fitted state with respect to a counterpart fitting part; a terminal fitting that is stored in the housing and electrically connected to a counterpart terminal fitting when the housing is in the completely fitted state; a lever member that is relatively rotatable with respect to the housing between a temporarily fitted position where the housing is in the temporarily fitted state and a completely fitted position where the housing is in the completely fitted state, the lever member relatively moving the housing with respect to the counterpart fitting part from the temporarily fitted state to the completely fitted state by a first rotation operation from the temporarily fitted position toward the completely fitted position, and relatively moving the housing with respect to the counterpart fitting part from the completely fitted state to the temporarily fitted state by a second rotation operation from the completely fitted position toward the temporarily fitted position; and a position ensuring member that is attached to be freely movable with respect to the housing between a fitting ensured position where the housing is in the completely fitted state and a standby position where the housing is not in the completely fitted state, wherein a first locking mechanism and a second locking mechanism are provided between the housing and the position ensuring member, the first locking mechanism locking move of the position ensuring member at the standby position in an ensuring-operation direction toward the fitting assured position when the lever member is not at the completely fitted position, and the second locking mechanism locking move of the position ensuring member at the fitting assured position in an ensuring-release direction that is a reverse direction of the ensuring-operation direction when the lever member is at the completely fitted position, and a locking release mechanism is provided between the lever member and the position ensuring member, the locking release mechanism releasing a locked state of the position ensuring member with the first locking mechanism when the lever member comes at the completely fitted position by associating a release operation of the locked state of the position ensuring member with the first locking mechanism with the first rotation operation of the lever member.

According to another aspect of the present invention, in the lever-type connector, it is possible to configure that the first locking mechanism includes a locking part provided to the housing, and a locked body provided to the position ensuring member, the locked body includes a protrusion that is disposed to oppose to the locking part within a space part on the ensuring-release direction side to lock the move of the position ensuring member in the ensuring-operation direction by the locking part when the position ensuring member is at the standby position, and a cantilever flexible part that has the protrusion provided at its free end and exhibits flexibility capable of allowing the free end to be displaced toward a protrusion insertion direction and a protrusion removal direction of the protrusion with respect to the space part when the position ensuring member is at the standby position, the protrusion includes a locked part that is locked with the locking part when the position ensuring member is at the standby position, the locking release mechanism includes a pushing part that is provided to the lever member to push and move the protrusion toward the protrusion removal direction in association with the first rotation operation of the lever member, and a pushed part that is provided to the protrusion to receive force from the pushing part, and the pushed part is formed as a locking-release tilted face that generates force in the protrusion removal direction based on force received from the pushing part by the first rotation operation, and releases a locked state of the locked part with the locking part when the lever member comes at the completely fitted position.

According to still another aspect of the present invention, in the lever-type connector, it is possible to configure that each of the locking part and the locked part is formed as a locking tilted face that generates force in the protrusion insertion direction based on force that is applied to the locked part from the locking part caused due to the move of the position ensuring member at the standby position in the ensuring-operation direction.

According to still another aspect of the present invention, in the lever-type connector, it is possible to configure that the protrusion includes a locking release part that is disposed to oppose to an end part of the locking part on the protrusion removal direction side within the space part on the ensuring-release direction side, when the position ensuring member is at the standby position and the lever member is at the completely fitted position, and the locking release part is formed as a locking-release tilted face that generates force in the protrusion removal direction based on force that is received from the end part of the locking part due to the move of the position ensuring member at the standby position in the ensuring-operation direction, and removes the protrusion from the space part.

According to still another aspect of the present invention, in the lever-type connector, it is possible to configure that the lever member includes two arms with a rotation fulcrum for the first rotation operation and the second rotation operation, the two arms being disposed to oppose to each other with a space being provided in an axial direction of a rotation shaft for the first rotation operation and the second rotation operation, and an operation part that connects the two arms and functions as a point of application of the first rotation operation and the second rotation operation, one each of the first locking mechanism and the second locking mechanism are provided in a part that is disposed in an opposing manner along the axial direction to one of the arms of the lever member at the completely fitted position, and in a part that is disposed in an opposing manner along the axial direction to the other one of the arms of the lever member at the completely fitted position, and the locking release mechanism is provided between one of the arms of the lever member and the position ensuring member and between the other one of the arms of the lever member and the position ensuring member, respectively.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Hereinafter, an embodiment of a lever-type connector according to the present invention will be described in detail by referring to the accompanying drawings. Note that the present invention is not limited by the embodiment.

Embodiment

The lever-type connector according to the present invention may be a connector that is fitted and connected to a mating connector to electrically connect an apparatus on the mating connector side with an apparatus to which the lever-type connector itself is connected, and may be a connector that is inserted or removed to/from the mating connector to perform connection and disconnection of an electrical circuit of the mating connector.

One of embodiments of the lever-type connector according to the present invention will be described by referring to FIG. 1 to FIG. 20.

Reference sign "1" in FIG. 1 to FIG. 9 indicates the lever-type connector of the embodiment. The lever-type connector 1 discussed herein as an example is configured to be freely inserted and removed to/from a mating connector 501, and functions on an electrical circuit of the mating connector 501 to connect and disconnect the electrical circuit.

Note here that the mating connector 501 is provided on the electrical circuit of a mating apparatus (not illustrated).

The mating apparatus may be a drive device of a vehicle (an electric motor, an inverter, or the like of an electric car or a hybrid car), for example. The mating connector 501 connects the electrical circuit of the mating apparatus when the lever-type connector 1 is fitted and connected, and disconnects the electrical circuit of the mating apparatus when the lever-type connector 1 is not fitted and connected.

Figure 1:
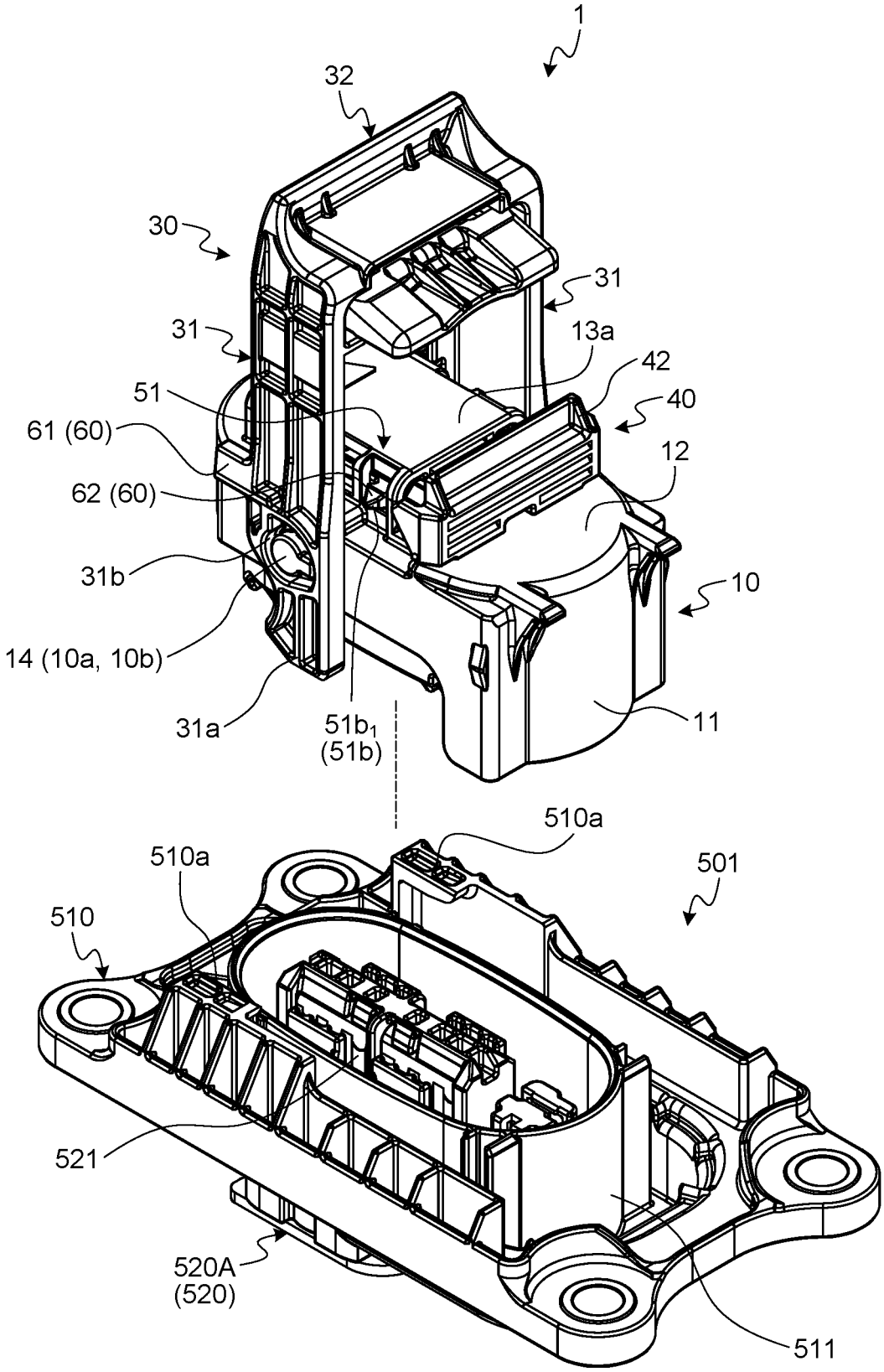
FIG. 1 is a perspective view illustrating a lever-type connector according to an embodiment along with a mating connector in a separated state.
Figure 2:
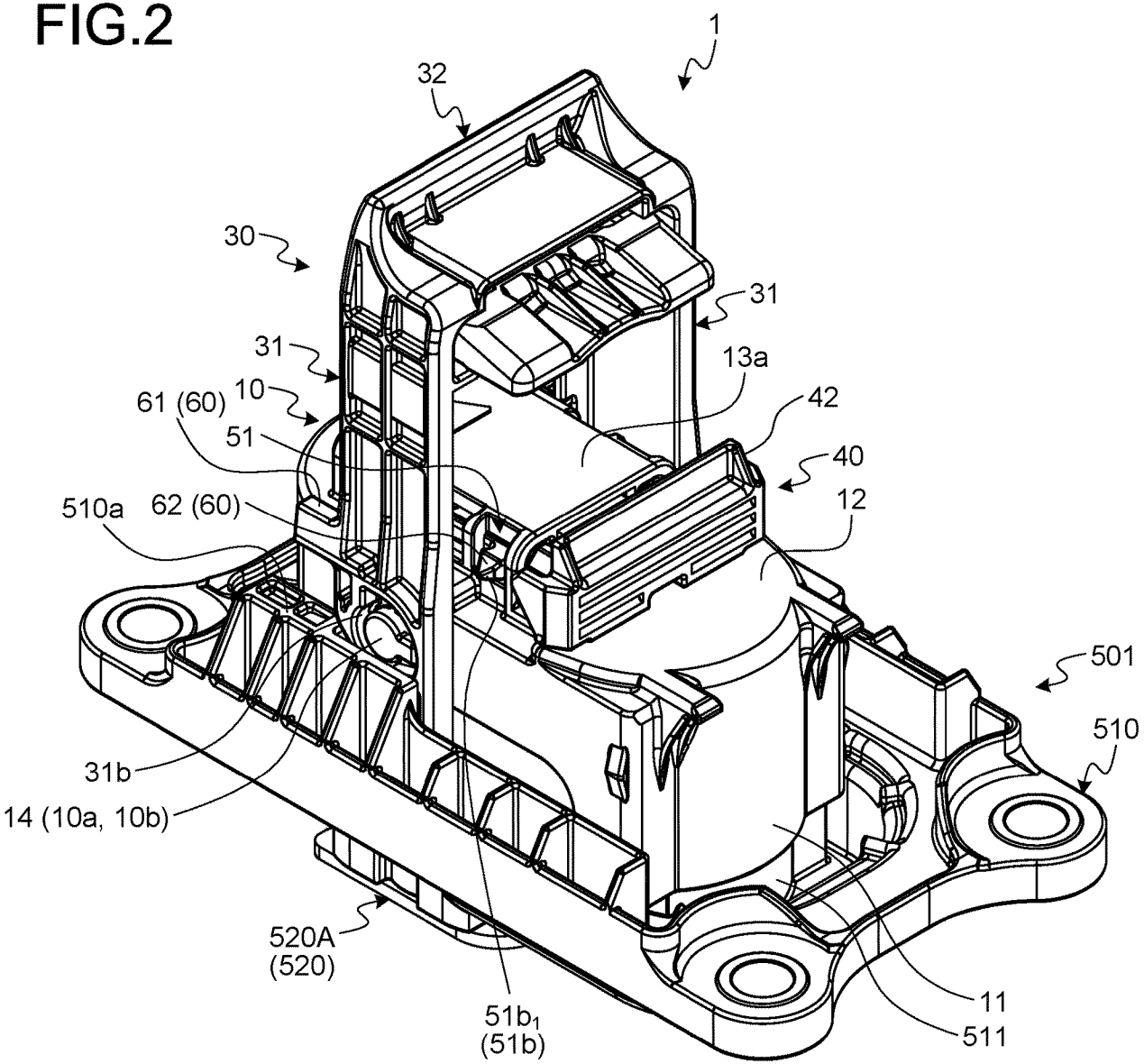
FIG. 2 is a perspective view illustrating a temporarily fitted state of the lever-type connector according to the embodiment with the mating connector.
Figure 10:
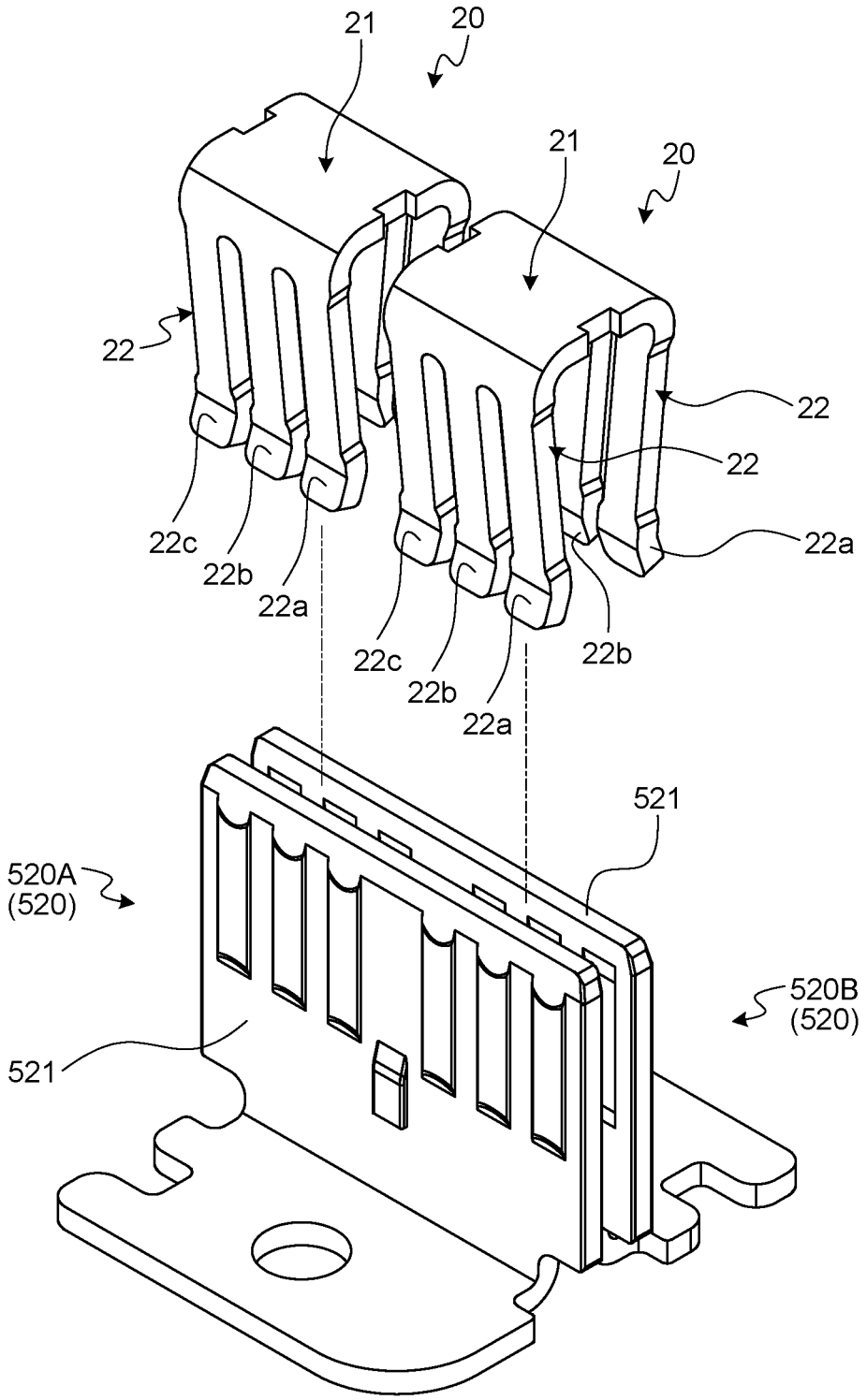
FIG. 10 is an exploded perspective view focusing on a terminal fitting and a counterpart terminal fitting.

The mating connector 501 discussed herein includes a mating housing 510 attached to a casing or the like of the mating apparatus, and a counterpart terminal fitting 520 is disposed inside a fitting part (hereinafter, referred to as "counterpart fitting part") 511 of the mating housing 510 (FIG. 1 and FIG. 2). The mating connector 501 includes: a first counterpart terminal fitting 520A that is electrically connected to one of divided electrical circuits in the mating apparatus; and a second counterpart terminal fitting 520B that is electrically connected to the other one of the divided electrical circuits (FIG. 10). The first counterpart terminal fitting 520A and the second counterpart terminal fitting 520B have respective mating electrical connection bodies 521 and 521 with a flat plate being a main body, and the flat faces of each of the mating electrical connection bodies 521 and 521 are disposed to oppose to each other with a space provided therebetween in the counterpart fitting part 511.

The lever-type connector 1, when fitted to a specified fitting position to the counterpart fitting part 511 as in a completely fitted state, electrically connects the first counterpart terminal fitting 520A and the second counterpart terminal fitting 520B so that the divided electrical circuits in the mating apparatus come in an electrically connected state. Meanwhile, the lever-type connector 1, when not fitted to the specified fitting position to the counterpart fitting part 511 as in a separated state or a half-fitted state, does not electrically connect the first counterpart terminal fitting 520A and the second counterpart terminal fitting 520B, so that the electrical circuits in the mating apparatus come in a disconnected state.

Figure 12:
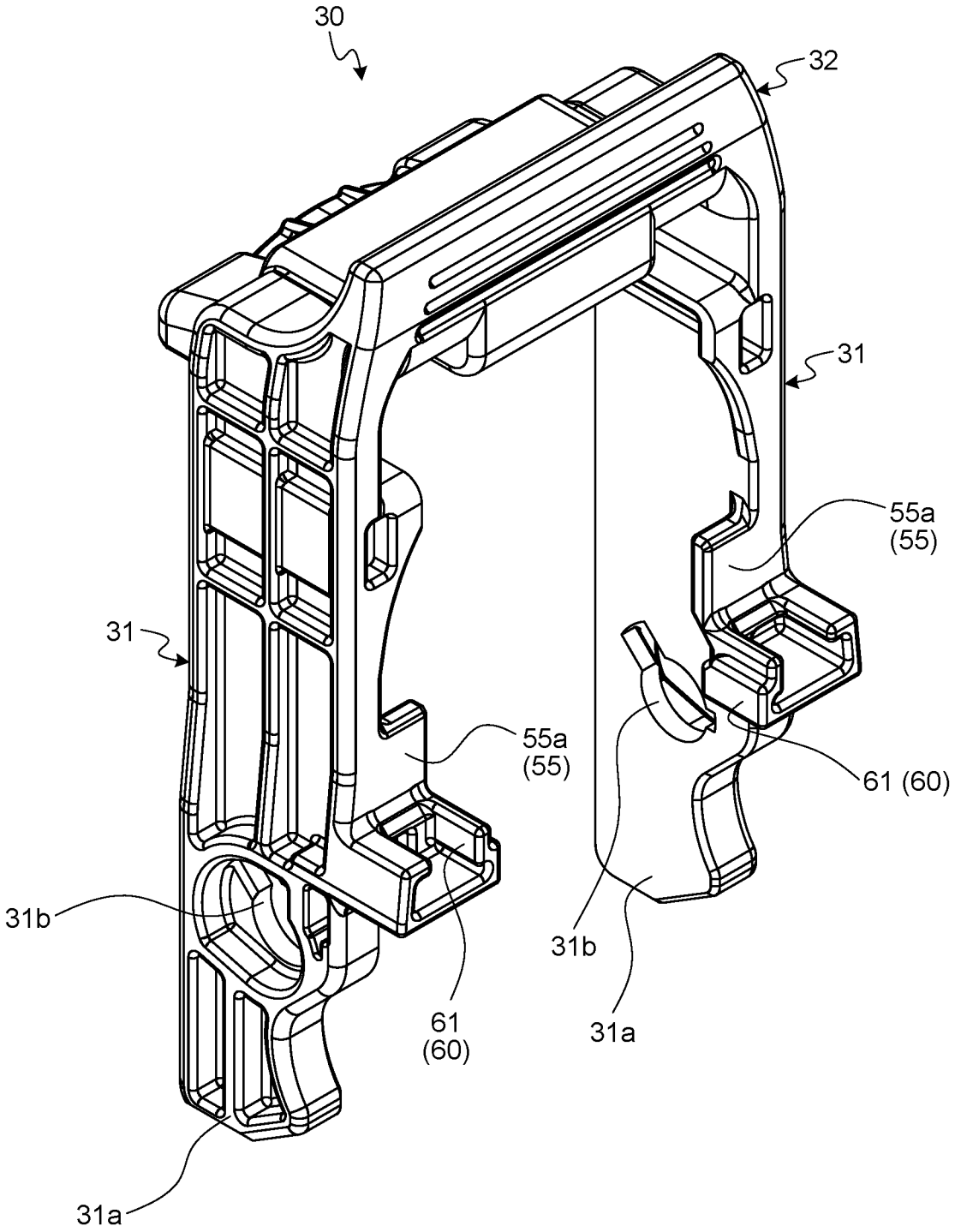
FIG. 12 is a perspective view illustrating a lever member.
Figure 13:
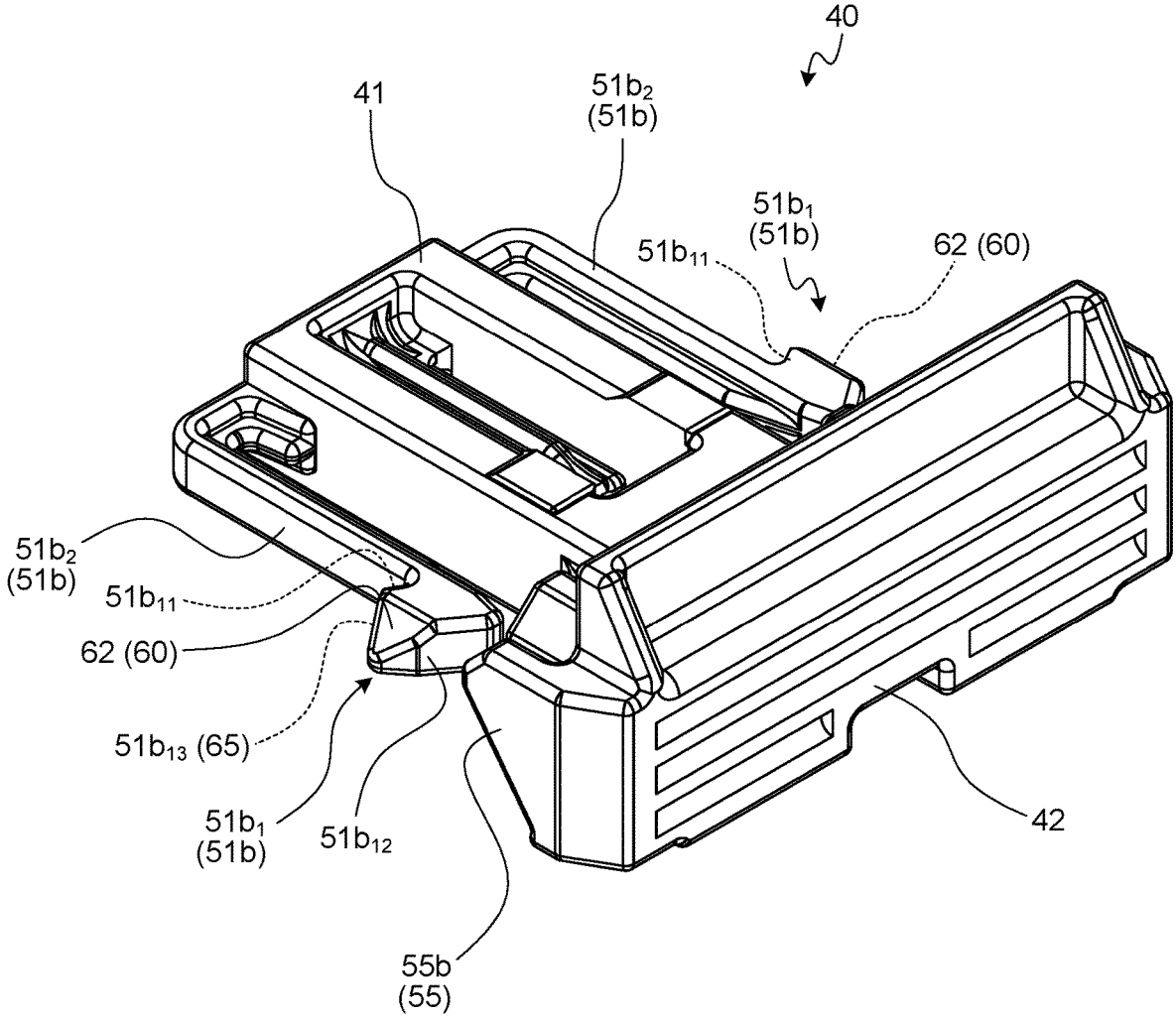
FIG. 13 is a perspective view illustrating a position ensuring member.

The lever-type connector 1 includes a housing 10 (FIG. 11), a terminal fitting 20 (FIG. 10), a lever member 30 (FIG. 12), and a position ensuring member 40 (FIG. 13).

The housing 10 is formed with an insulating material such as a synthetic resin. The housing 10 has a fitting part 11 that can be inserted and removed to/from the counterpart fitting part 511 (FIG. 1 to FIG. 9, and FIG. 11). The fitting part 11 and the counterpart fitting part 511 are formed in a cylindrical shape, and inserted and removed with respect to each other with the cylinder axis direction being the connector insertion/removal directions (connector insertion direction, connector removal direction). As for the fitting part 11 and the counterpart fitting part 511 discussed herein, orthogonal cross sections thereof with respect to the cylinder axis direction are formed as oval cylindrical bodies.

As for the lever-type connector 1, the tip of the fitting part 11 in the cylinder axis direction is fitted to the tip of the counterpart fitting part 511 in the cylinder axis direction to be in a temporarily fitted state (one form of a half-fitted state) (FIG. 2 and FIG. 3) and the lever member 30 is rotationally operated in the temporarily fitted state, so that the fitting part 11 and the counterpart fitting part 511 are deeply fitted to a specified fitting position to be in a completely fitted state (FIG. 6 to FIG. 9). Meanwhile, with the lever-type connector 1, the fitting part 11 and the counterpart fitting part 511 are displaced to a temporarily fitted state by rotationally operating the lever member 30 to a reverse direction when the fitting part 11 and the counterpart fitting part 511 are in a completely fitted state. The lever-type connector 1 in the temporarily fitted state is also in a removable state where the fitting part 11 can be removed from the counterpart fitting part 511, and the fitting part 11 is taken out from the counterpart fitting part 511 to be separated from the mating connector 501. As described, the fitting part 11 of the housing 10 is formed to be relatively movable along the connector insertion/removal directions with respect to the counterpart fitting part 511 between the temporarily fitted state with the counterpart fitting part 511 and the completely fitted state with the counterpart fitting part 511.

Furthermore, the housing 10 includes a closing part 12 that closes an opening at a rear end of the fitting part 11 in the cylinder axis direction (FIG. 1 to FIG. 9, and FIG. 11). In the housing 10, a storage chamber 13 for storing the position ensuring member 40 is formed in a protruded state from an outer wall face of the closing part 12 (FIG. 3, FIG. 5, FIG. 7, FIG. 9, and FIG. 11). The housing 10 discussed herein includes: a wall part 13*a* that is disposed to oppose to the outer wall face of the closing part 12 with a space provided therebetween; and two sidewall parts 13*b* and 13*b* that are disposed to oppose to each other with a space provided therebetween for connecting the outer wall face of the closing part 12 and the wall part 13*a* (FIG. 3, FIG. 5, FIG. 7, FIG. 9, and FIG. 11). In the housing 10, the space surrounded by the closing part 12, the wall part 13*a*, and the two sidewall parts 13*b* and 13*b* is used as the storage chamber 13, and the position ensuring member 40 is inserted from an opening 13*c* of the storage chamber 13 (FIG. 3, FIG. 5, FIG. 7, FIG. 9, and FIG. 11).

The terminal fitting 20 is formed with a conductive material such as a metal. For example, the terminal fitting 20 is formed in a prescribed shape by press molding such as bending and cutting performed on a metal plate as a base material. The terminal fitting 20 is stored inside the fitting part 11 of the housing 10. Furthermore, when the fitting part 11 and the counterpart fitting part 511 are in a completely fitted state, the terminal fitting 20 is fitted and connected to the counterpart terminal fitting 520 to be electrically connected with the counterpart terminal fitting 520.

The terminal fitting 20 includes: a rectangular base body 21; and cantilever electrical connection bodies 22 and 22 protruded, respectively, from two sides of the base body 21 extended in a same direction (FIG. 10). As for the terminal fitting 20, respective mating electrical connection bodies 521 and 521 of the first counterpart terminal fitting 520A and the second counterpart terminal fitting 520B are fitted between each of the electrical connection bodies 22 and 22 to sandwich each of the mating electrical connection bodies 521 and 521 by each of the electrical connection bodies 22 and 22 so as to be fitted and connected to each of the mating electrical connection bodies 521 and 521. Thereby, one of the electrical connection bodies 22 of the terminal fitting 20 is electrically connected to the first counterpart terminal fitting 520A and the other electrical connection body 22 is electrically connected to the second counterpart terminal fitting 520B, thereby electrically connecting the first counterpart terminal fitting 520A and the second counterpart terminal fitting 520B.

In the terminal fitting 20 discussed herein, each of the electrical connection bodies 22 and 22 is disposed in an opposing manner while making an included angle, and contact points for the mating electrical connection bodies 521 and 521 are provided on the free end sides of the respective electrical connection bodies 22 and 22. Furthermore, the electrical connection body 22 of the terminal fitting 20 discussed herein is divided into a plurality of cantilever electrical connection parts by slits extended in the protrusion direction thereof, and each of the electrical connection parts has a contact point for the mating electrical connection body 521. The electrical connection body 22 discussed herein as an example is divided into three electrical connection parts 22*a*, 22*b*, and 22*c* by two slits (FIG. 10).

In the lever-type connector 1, two pieces of the terminal fittings 20 are disposed side by side inside the fitting part 11.

The lever member 30 is formed with an insulating material such as a synthetic resin. The lever member 30 is a member that can be relatively rotated with respect to the housing 10, and the force of a connector insertion direction and the force of a connector removal direction generated according to the direction of the relative rotation is applied between the fitting part 11 and the counterpart fitting part 511. Thus, the lever member 30 is relatively rotated at least between a temporarily fitted position when the housing 10 is in a temporarily fitted state (FIG. 2) and a completely fitted position when the housing 10 is in a completely fitted state (FIG. 6 to FIG. 9). The lever member 30 relatively moves the housing 10 from the temporarily fitted state to the completely fitted state with respect to the counterpart fitting part 511 by a first rotational operation (FIG. 2) from the temporarily fitted position toward the completely fitted position to fully fit the fitting part 11 and the counterpart fitting part 511. Furthermore, the lever member 30 relatively moves the housing 10 from the completely fitted state to the temporarily fitted state with respect to the counterpart fitting part 511 by a second rotational operation (FIG. 2) from the completely fitted position toward the temporarily fitted position to release the completely fitted state of the fitting part 11 and the counterpart fitting part 511.

The lever member 30 includes: two arms 31 and 31 that have a rotation fulcrum for the first rotational operation and the second rotational operation, and are disposed to oppose to each other with a space provided therebetween in an axial direction of the rotation axis of the first rotational operation and the second rotational operation; and an operation part 32 that connects the two arms 31 and 31, and functions as the point of application of the first rotational operation and the second rotational operation (FIG. 1, FIG. 2, FIG. 4 to FIG. 9, and FIG. 12).

In the lever member 30 discussed herein, the fitting part 11 is disposed between the two arms 31 and 31, and each of the arms 31 and 31 is attached to be freely rotatable to the fitting part 11. Furthermore, as for the lever member 30 discussed herein at the temporarily fitted position, the extending direction of each of the arms 31 and 31 is set to face toward the connector insertion/removal directions, and the operation part 32 is disposed to oppose to the wall part 13*a* of the storage chamber 13 with a space provided therebetween (FIG. 2). Furthermore, as for the lever member 30 discussed herein at the completely fitted position, the extending direction of each of the arms 31 and 31 is set to face toward the orthogonal direction of the connector insertion/removal directions, and the operation part 32 is disposed to oppose to the outer circumference of the fitting part 11 (FIG. 6 to FIG. 9).

Figure 11:
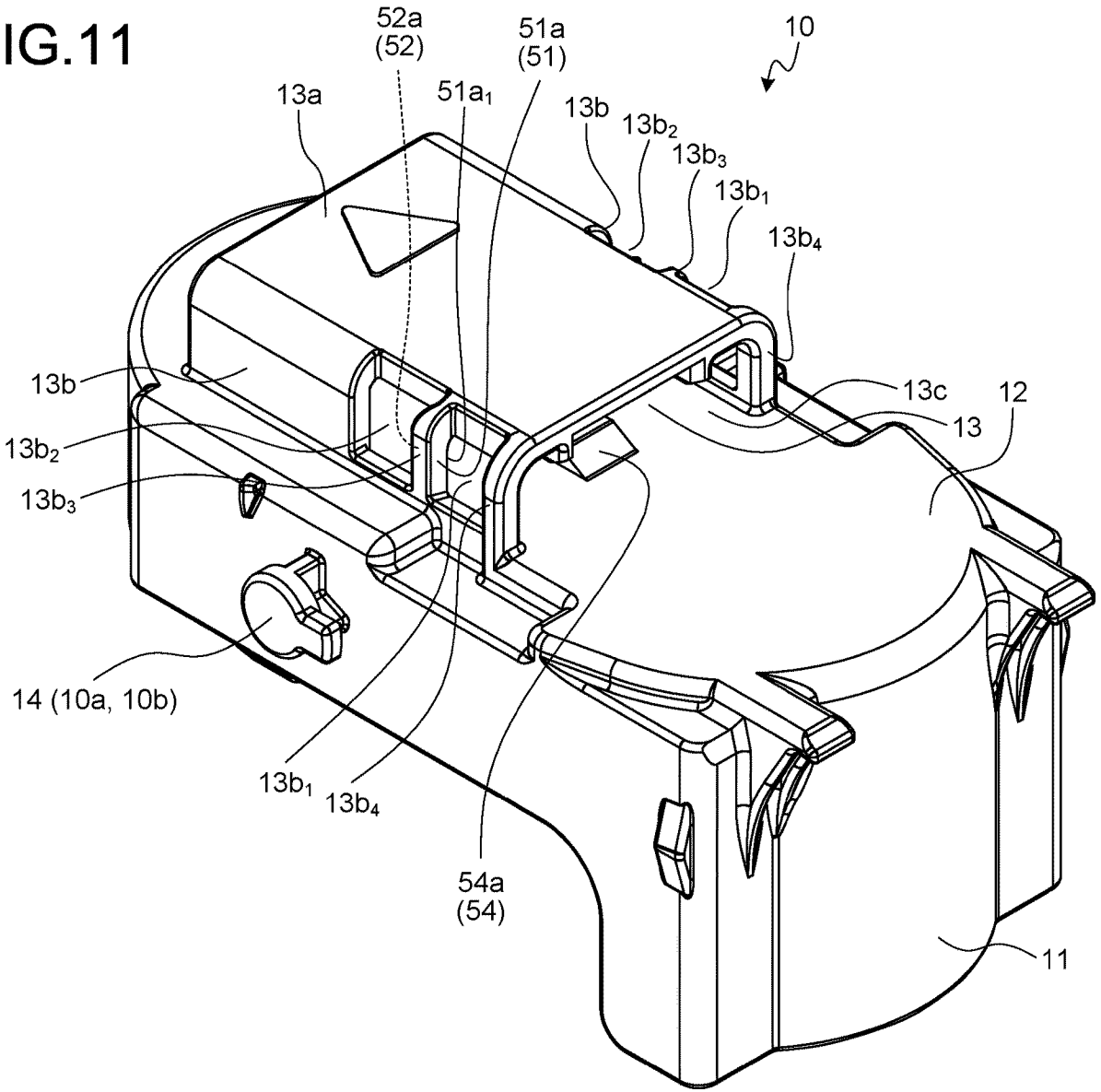
FIG. 11 is a perspective view illustrating a housing.
Figure 14:
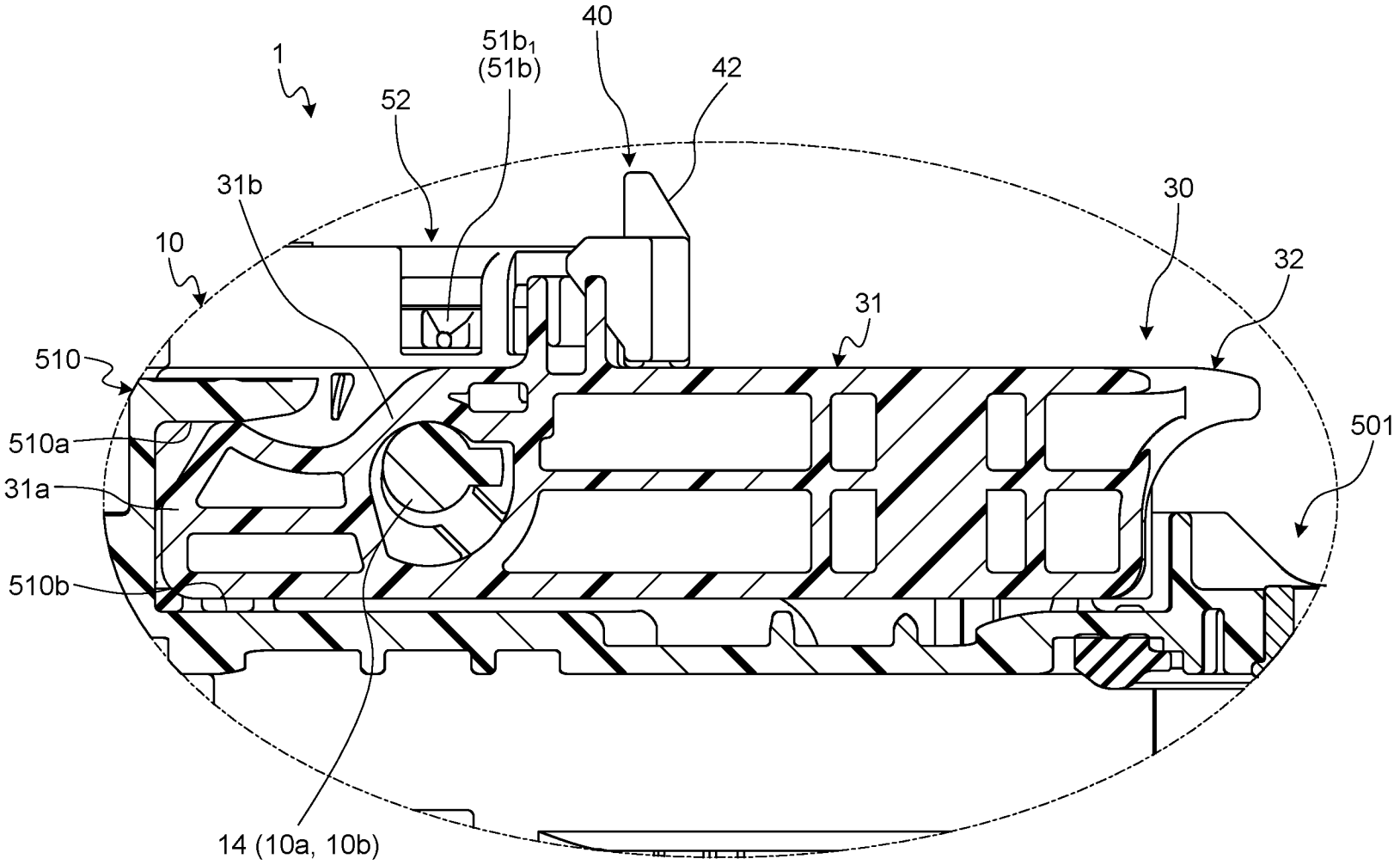
FIG. 14 is a fragmentary enlarged view of a section taken along a line X1-X1 in FIG. 9.

The arm 31 is formed in a cantilever shape with its operation part 32 side being a fixed end, and the rotation fulcrum is provided between the fixed end and a free end 31*a* (FIG. 1, FIG. 2, FIG. 12, and FIG. 14). As for the arm 31 discussed herein, a bearing 31*b* having a circular through-hole is formed as the rotation fulcrum (FIG. 1, FIG. 12, and FIG. 14). On the outer circumference of the fitting part 11, a rotation shaft 14 that is inserted into the through-hole of the bearing 31*b* and supported by the bearing 31*b* is provided in a protruded state for each of the arms 31 (FIG. 1 to FIG. 3, FIG. 11, and FIG. 14).

The mating housing 510 includes a first reception part 510*a* that receives force toward the connector removal direction from the free end 31*a* of the lever member 30 during the first rotational operation of the lever member 30 (FIG. 1 to FIG. 9, and FIG. 14). The lever member 30 receives a reaction force from the first reception part 510*a* generated by applying the force toward the connector removal direction on the first reception part 510*a*. Thus, in the housing 10, provided is a second reception part 10*a* that generates force toward the connector insertion direction in the fitting part 11 by receiving the force from the rotation fulcrum of the lever member 30 that has received the reaction force from the first reception part 510*a* during the first rotational operation of the lever member 30 (FIG. 1 to FIG. 3, FIG. 11, and FIG. 14). Thereby, with the lever-type connector 1, the fitting part 11 and the counterpart fitting part 511 in a temporarily fitted state are fitted into a specified fitting position to be in a completely fitted state through performing the first rotational operation of the lever member 30. That is, the lever-type connector 1 is capable of decreasing the fitting operation force of an operator when transferring the fitting part 11 and the counterpart fitting part 511 from the temporarily fitted state to the completely fitted state. The second reception part 10*a* discussed herein is the rotation shaft 14 (FIG. 1 to FIG. 3, FIG. 11, and FIG. 14), and force according to the reaction force from the first reception part 510*a* is applied from an inner peripheral wall of the through-hole of the bearing 31*b*.

Figure 3:
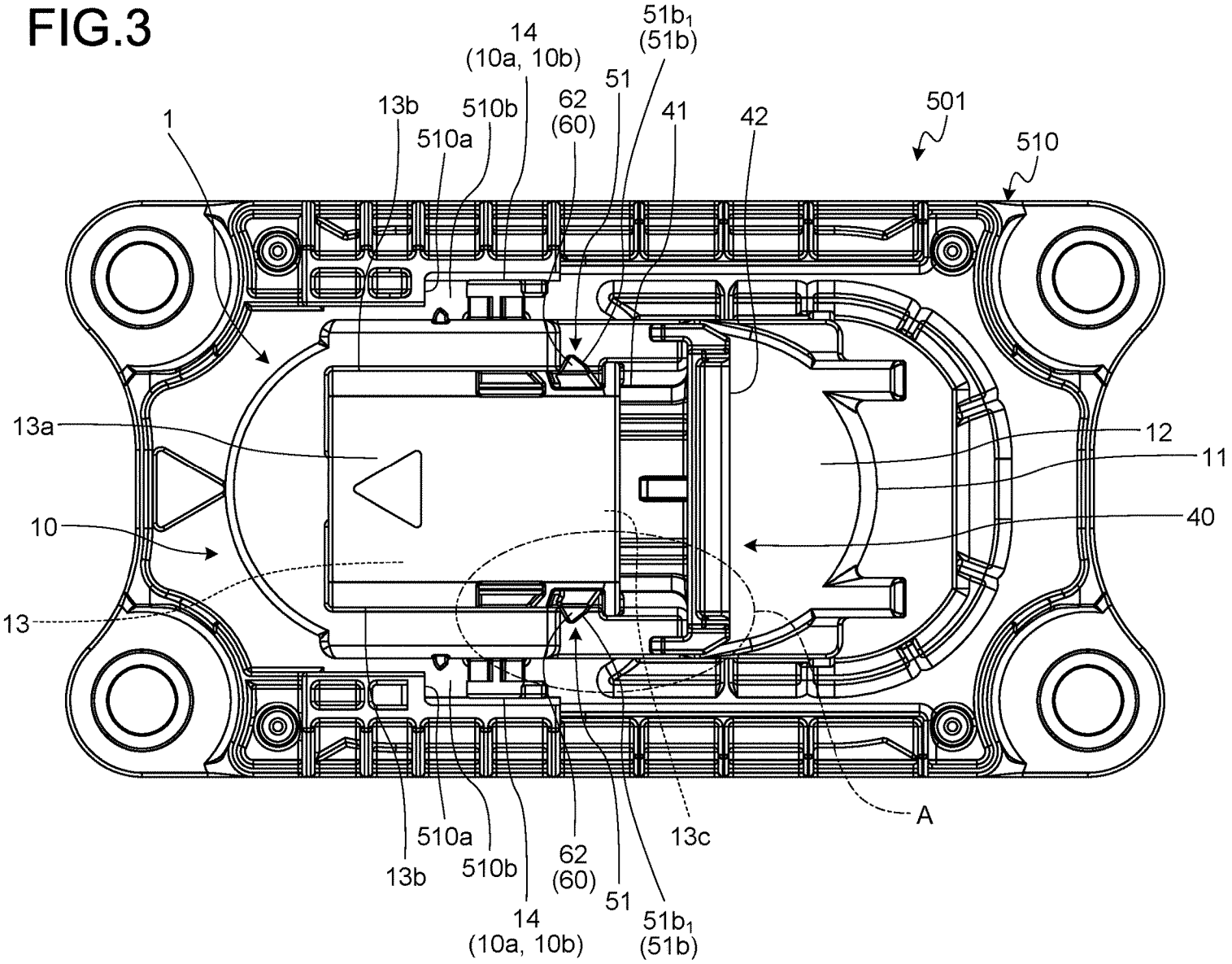
FIG. 3 is a plan view illustrating a temporarily fitted state of the lever-type connector (except a lever member) according to the embodiment with the mating connector.
Figure 4:
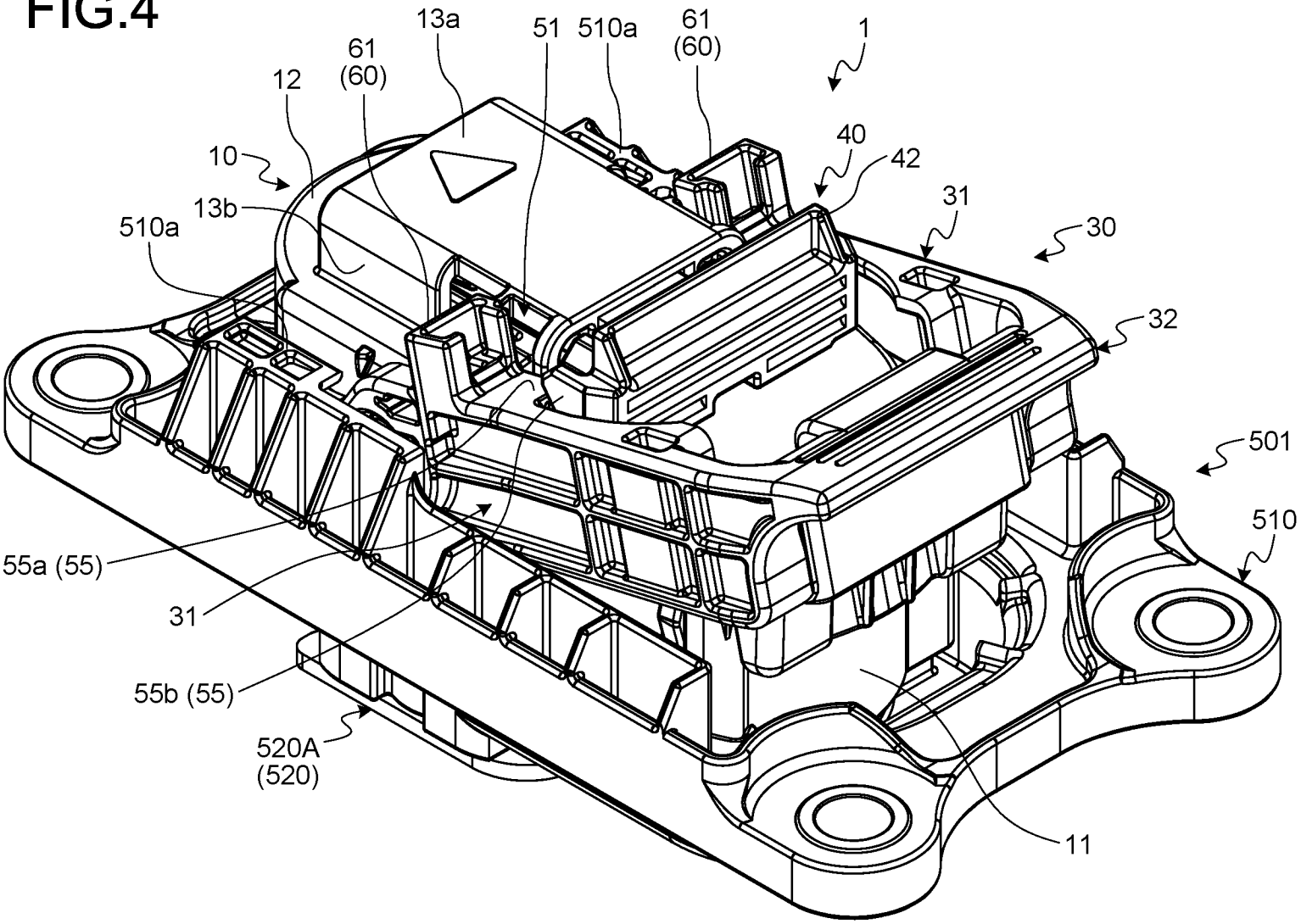
FIG. 4 is a perspective view illustrating a state during a fitting operation or a removal operation of the lever-type connector according to the embodiment to the mating connector, and is a diagram illustrating a locking-release start time of a position ensuring member at a standby position or a locking start time of the position ensuring member at the standby position.
Figure 5:
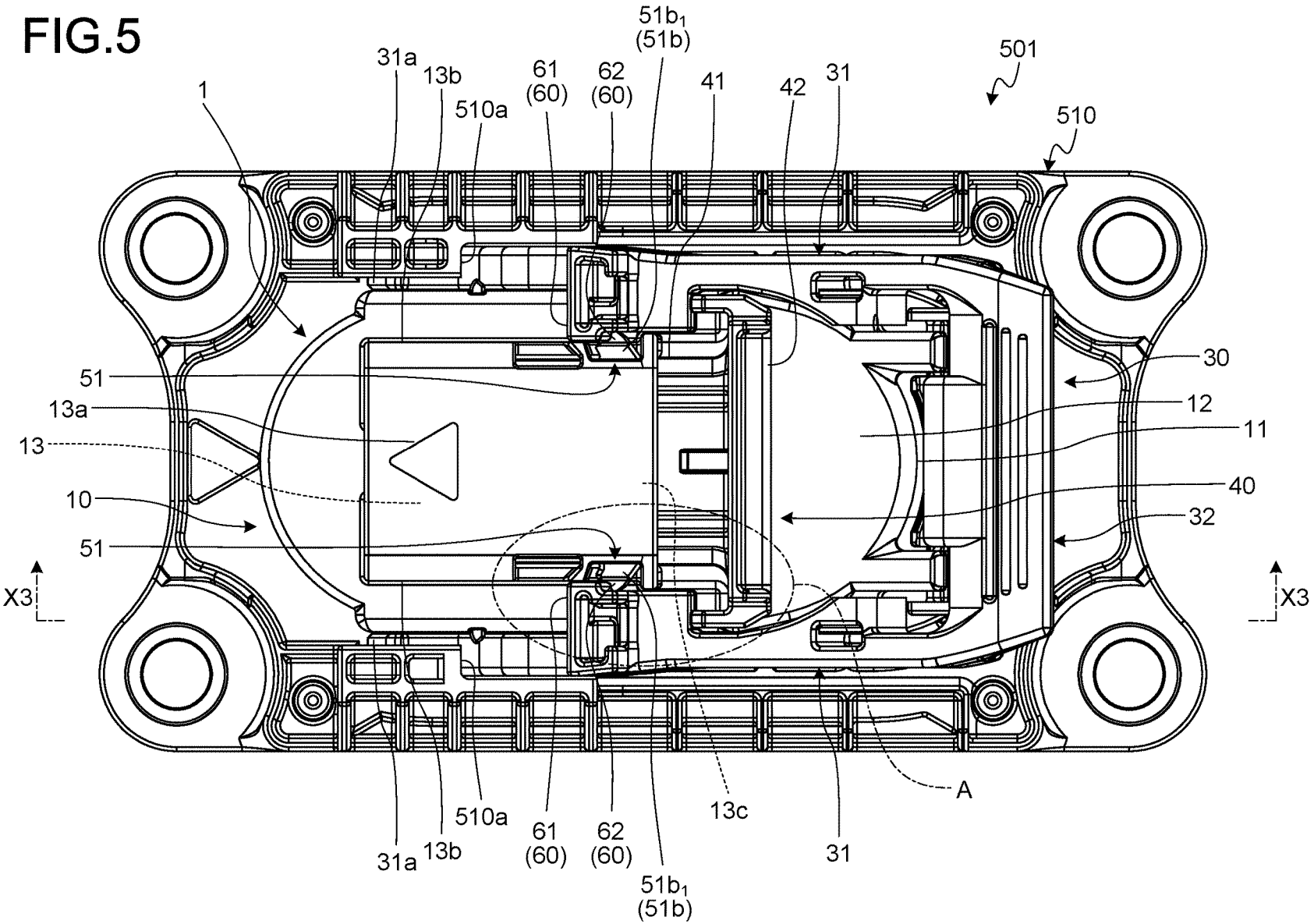
FIG. 5 is a plan view illustrating a state during the fitting operation or the removal operation of the lever-type connector according to the embodiment to the mating connector, and is a diagram illustrating the locking-release start time of the position ensuring member at the standby position or the locking start time of the position ensuring member at the standby position.
Figure 6:
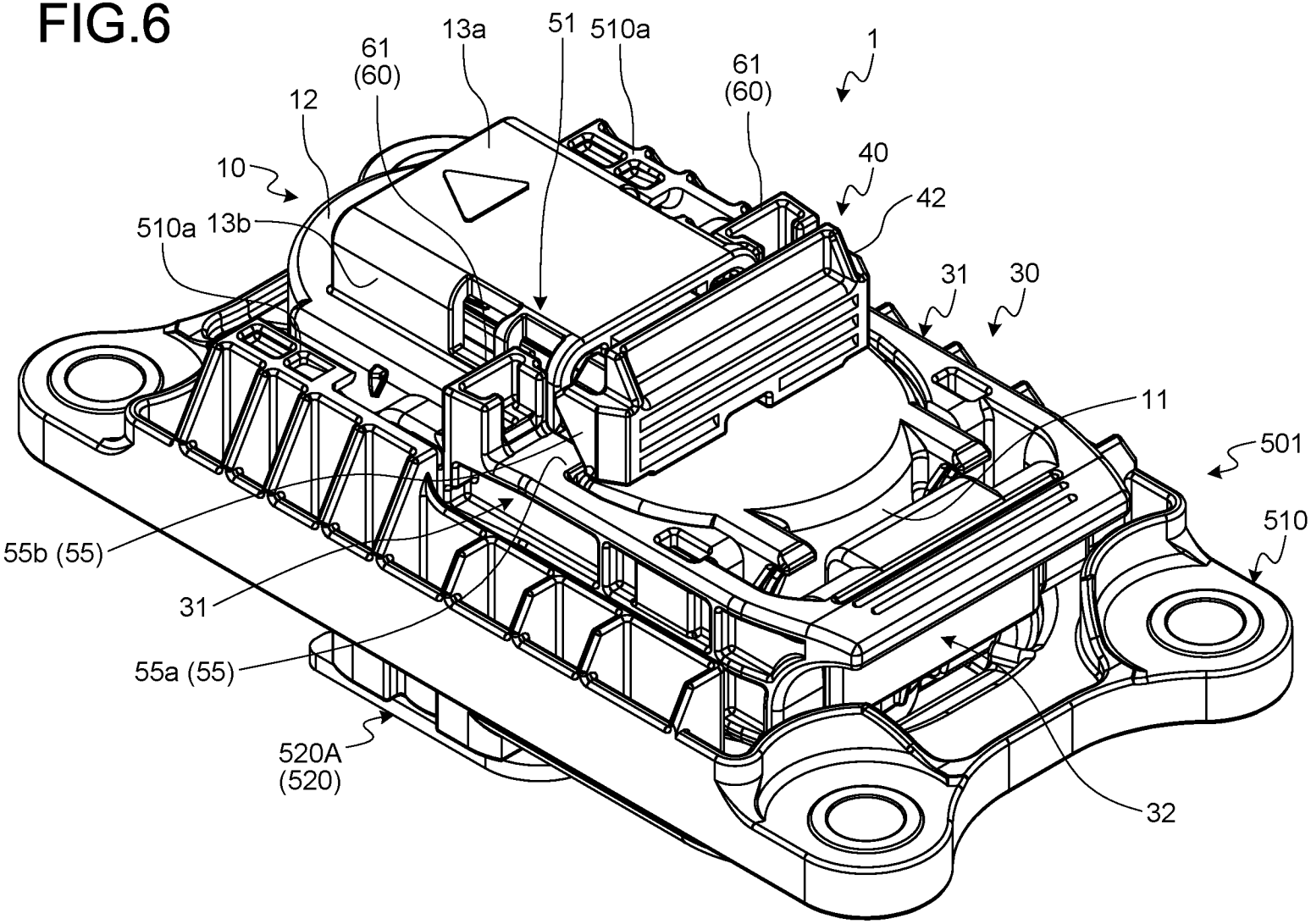
FIG. 6 is a perspective view illustrating a completely fitted state of the lever-type connector according to the embodiment to the mating connector and also a state where the position ensuring member is at the standby position.
Figure 7:
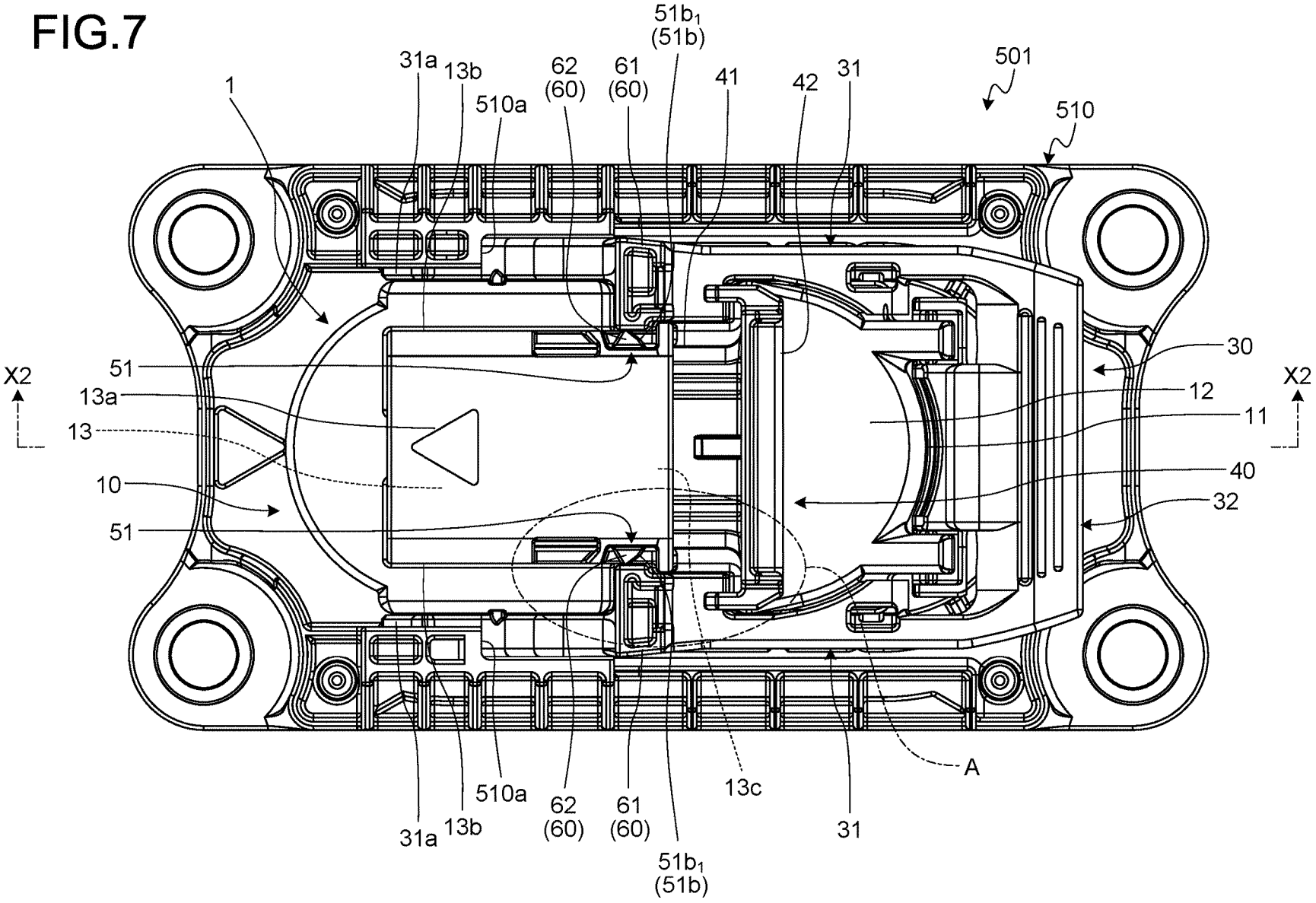
FIG. 7 is a plan view illustrating the completely fitted state of the lever-type connector according to the embodiment to the mating connector and also a state where the position ensuring member is at the standby position.
Figure 8:
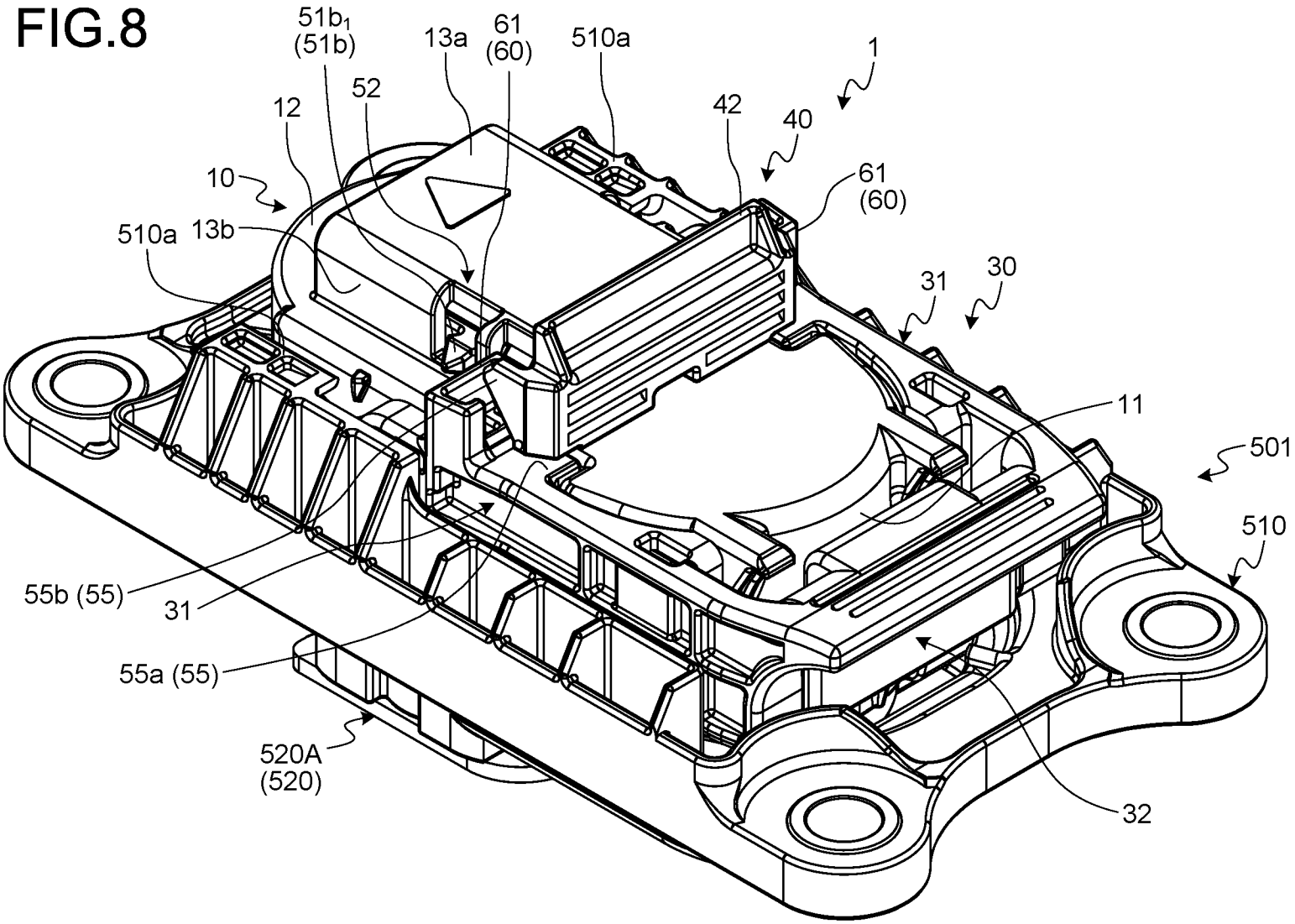
FIG. 8 is a perspective view illustrating a completely fitted state of the lever-type connector according to the embodiment to the mating connector and also a state where the position ensuring member is at a fitting ensured position.
Figure 9:
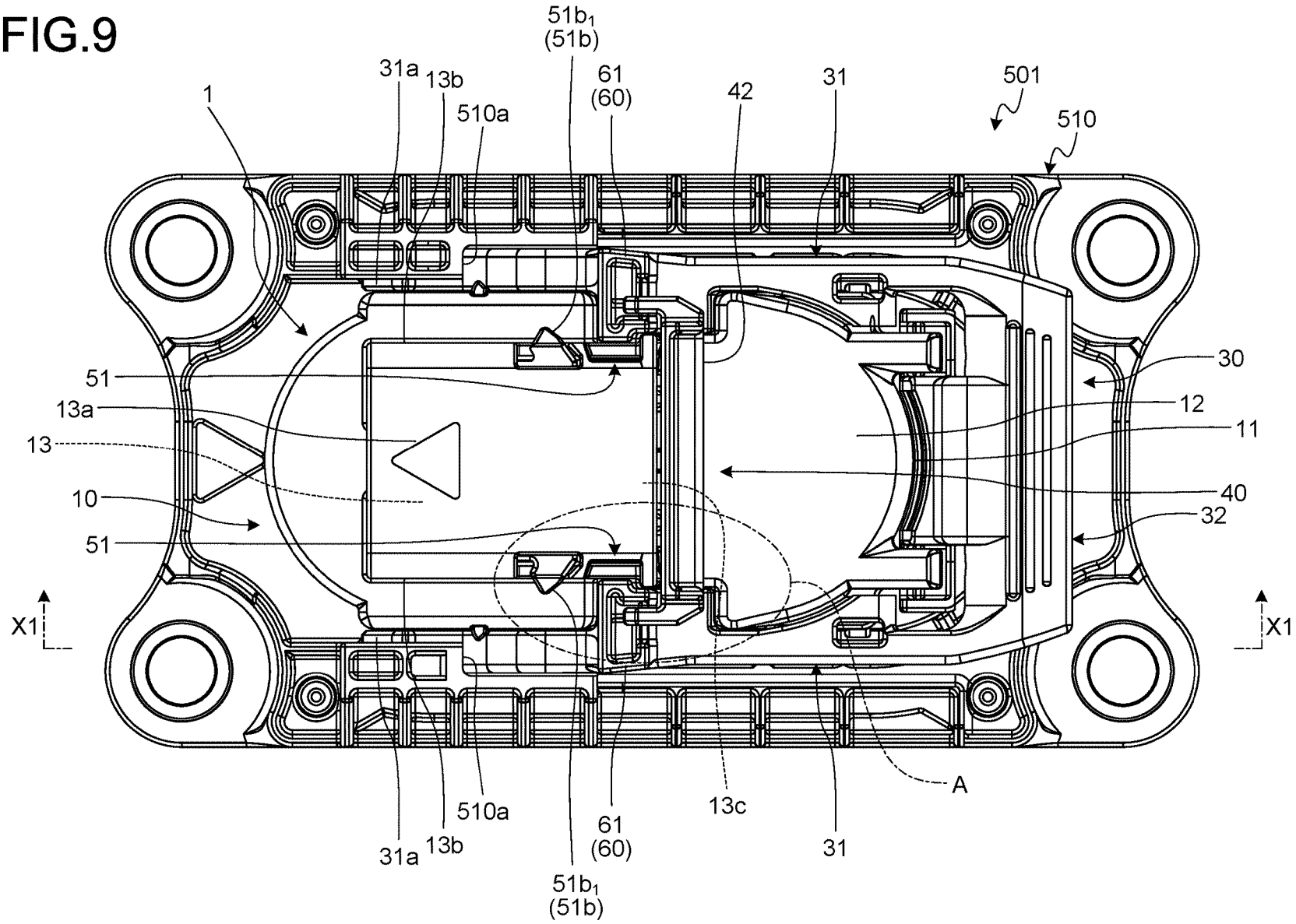
FIG. 9 is a plan view illustrating the completely fitted state of the lever-type connector according to the embodiment to the mating connector and also a state where the position ensuring member is at the fitting ensured position.

Furthermore, the mating housing 510 includes a third reception part 510*b* that receives force toward the connector insertion direction from the free end 31*a* of the lever member 30 during the second rotational operation of the lever member 30 (FIG. 3 and FIG. 14). The third reception part 510*b* is disposed to oppose to the first reception part 510*a* with a space provided therebetween. The lever member 30 receives a reaction force from the third reception part 510*b* generated by the force toward the connector insertion direction applied to the third reception part 510*b*. Thus, in the housing 10, provided is a fourth reception part 10*b* that generates force toward the connector removal direction in the fitting part 11 by receiving the force from the rotation fulcrum of the lever member 30 that has received the reaction force from the third reception part 510*b* during the second rotational operation of the lever member 30 (FIG. 1 to FIG. 3, FIG. 11, and FIG. 14). Thereby, with the lever-type connector 1, a fitting allowance of the fitting part 11 and the counterpart fitting part 511 in a completely fitted state is decreased to be in a temporarily fitted state through performing the second rotational operation of the lever member 30. That is, the lever-type connector 1 is capable of decreasing the removal operation force of the operator when transferring the fitting part 11 and the counterpart fitting part 511 from the completely fitted state to the temporarily fitted state. The fourth reception part 10*b* discussed herein is the rotation shaft 14 same as that of the second reception part 10*a* (FIG. 1 to FIG. 3, FIG. 11, and FIG. 14), and force according to the reaction force from the third reception part 510*b* is applied from the inner peripheral wall of the through-hole of the bearing 31*b*.

The position ensuring member 40 is formed with an insulating material such as a synthetic resin. The position ensuring member 40 is attached to the housing 10 to be freely movable between a fitting ensured position where the housing 10 is in a completely fitted state and a standby position where the housing 10 is not in a completely fitted state. As described above, a completely fitted state of the housing 10 is a state where the terminal fitting 20 and the counterpart terminal fitting 520 are electrically connected. Accordingly, a state where the housing 10 is not in a completely fitted state means a state where the terminal fitting 20 and the counterpart terminal fitting 520 are not electrically connected, which is a half-fitted state of the housing 10 with respect to the mating housing 510 or a separated state of the housing 10 with respect to the mating housing 510.

The position ensuring member 40 is formed in a cuboid shape, and includes: a main body 41 that is stored in the storage chamber 13 of the housing 10 from the opening 13*c*; and an operation part 42 that is provided at one wall face of the main body 41 and disposed outside the storage chamber 13 (FIG. 3, FIG. 5, FIG. 7, FIG. 9, FIG. 13, and FIG. 15). As for the position ensuring member 40, the operation part 42 is pushed and moved so as to relatively move the main body 41 from a standby position to a fitting ensured position in the storage chamber 13. Furthermore, as for the position ensuring member 40, the operation part 42 is pulled inversely so as to relatively move the main body 41 from the fitting ensured position to the standby position in the storage chamber 13.

As for the position ensuring member 40, relative move from the standby position to the fitting ensured position when the lever member 30 is not at a completely fitted position is restricted, and relative move from the fitting ensured position to the standby position when the lever member 30 is at the completely fitted position is restricted. As described above, the completely fitted position of the lever member 30 is a relatively rotated position of the lever member 30 with respect to the housing 10 when the housing 10 is in the completely fitted state. Accordingly, a position where the lever member 30 is not at the completely fitted position is a relatively rotated position of the lever member 30 with respect to the housing 10 when the housing 10 is not in the completely fitted state, which includes not only the temporarily fitted position of the lever member 30 but also a relatively rotated position of the lever member 30 with respect to the housing 10 when the lever member 30 is displaced between the temporarily fitted position and the completely fitted position.

Between the housing 10 and the position ensuring member 40, provided is a first locking mechanism 51 that locks the move in an ensuring-operation direction of the position ensuring member 40 at the standby position toward the fitting ensured position when the lever member 30 is not at the completely fitted position in order to restrict the relative move of the position ensuring member 40 from the standby position to the fitting ensured position when the lever member 30 is not at the completely fitted position (FIG. 1 to FIG. 7, FIG. 11, and FIG. 16 to FIG. 19). Furthermore, between the housing 10 and the position ensuring member 40, provided is a second locking mechanism 52 that locks the move of the position ensuring member 40 at the fitting ensured position to an ensuring-release direction that is a reverse direction of the ensuring-operation direction when the lever member 30 is at the completely fitted position in order to restrict the relative move of the position ensuring member 40 from the fitting ensured position to the standby position when the lever member 30 is at the completely fitted position (FIG. 8, FIG. 9, FIG. 11, and FIG. 16 to FIG. 19). One each of the first locking mechanism 51 and the second locking mechanism 52 are provided between one of the sidewall parts 13*b* of the housing 10 and the position ensuring member 40 and between the other sidewall part 13*b* of the housing 10 and the position ensuring member 40. Furthermore, paying attention to the lever member 30 at the completely fitted position, the first locking mechanism 51 and the second locking mechanism 52 are provided in a part to be disposed in an opposing manner along the axial direction (axial direction of the rotation shaft of the lever member 30) with respect to one of the arms 31 of the lever member 30 at the completely fitted position and in a part to be disposed in an opposing manner along the axial direction (axial direction of the rotation shaft of the lever member 30) with respect to the other arm 31 of the lever member 30 at the completely fitted position, respectively.

The first locking mechanism 51 includes: a locking part (referred to as "first locking part hereinafter) 51*a* provided to the housing 10 (FIG. 11, and FIG. 16 to FIG. 19); and a locked body (referred to as "first locked body" hereinafter) 51*b* provided to the position ensuring member (FIG. 1 to FIG. 3, FIG. 5, FIG. 7, FIG. 13, and FIG. 16 to FIG. 19). The first locking mechanism 51 restricts the relative move of the position ensuring member 40 from the standby position to the fitting ensured position by disposing the first locking part 51*a* and the first locked body 51*b* when the position ensuring member 40 is at the standby position.

The second locking mechanism 52 includes a locking part (referred to as "second locking part" hereinafter) 52*a* provided to the housing 10 (FIG. 11, and FIG. 16 to FIG. 19). The second locking mechanism 52 restricts the relative move of the position ensuring member 40 from the fitting ensured position to the standby position by disposing the second locking part 52*a* and the locked body of the position ensuring member 40 in a lockable state when the position ensuring member 40 is at the fitting ensured position. As for the second locking mechanism 52, the position ensuring member 40 may also include a locked body exclusively for the second locking mechanism 52 separately from the first locked body 51*b* of the first locking mechanism 51. Note, however, that the first locked body 51*b* is used in common by the first locking mechanism 51 and the second locking mechanism 52 (FIG. 1 to FIG. 3, and FIG. 16 to FIG. 19).

In the sidewall part 13*b*, a space part (referred to as "first space part" hereinafter) $\mathbf{13}b_1$ configured with a first through-hole and a space part (referred to as "second space part" hereinafter) $\mathbf{13}b_2$ configured with a second through-hole are formed in order from the opening 13*c* side (FIG. 11, and FIG. 16 to FIG. 19). By providing the first space part $\mathbf{13}b_1$ and the second space part $\mathbf{13}b_2$ in the sidewall part 13*b*, a first wall body $\mathbf{13}b_3$ is formed between the first space part $\mathbf{13}b_1$ and the second space part $\mathbf{13}b_2$, and a second wall body $\mathbf{13}b_4$ is formed on the opening 13*c* side of the first space part $\mathbf{13}b_1$ (FIG. 11, and FIG. 16 to FIG. 19). Each of the first space part $\mathbf{13}b_1$ and the second space part $\mathbf{13}b_2$ discussed herein is formed in a cuboid shape. Furthermore, each of the first wall body $\mathbf{13}b_3$ and the second wall body $\mathbf{13}b_4$ discussed herein is formed in a columnar shape. In the first locking mechanism 51, the wall face of the first wall body $\mathbf{13}b_3$ on the first space part $\mathbf{13}b_1$ side is used as the first locking part 51*a*. In the second locking mechanism 52, the wall face of the first wall body $\mathbf{13}b_3$ on the second space part $\mathbf{13}b_2$ side is used as the second locking part 52*a*.

The first locked body 51*b* includes: a protrusion $\mathbf{51}b_1$ that is disposed to oppose to the first locking part 51*a* inside the first space part $\mathbf{13}b_1$ on the ensuring-release direction side for locking the move of the position ensuring member 40 in the ensuring-operation direction by the first locking part 51*a* when the position ensuring member 40 is at the standby position; and a cantilever flexible part $\mathbf{51}b_2$ that has the protrusion $\mathbf{51}b_1$ provided at its free end, and exhibits flexibility capable of allowing the free end to be displaced toward an insertion direction of the protrusion 51$b_1$ (referred to as "protrusion insertion direction" hereinafter) and toward a removal direction (referred to as "protrusion removal direction" hereinafter) to/from the first space part 13$b_1$ when the position ensuring member 40 is at the standby position (FIG. 13, and FIG. 16 to FIG. 19).

The protrusion 51$b_1$ discussed herein is also disposed to oppose to the second locking part 52*a* within the second space part 13$b_2$ on the ensuring-operation direction side for locking the move of the position ensuring member 40 in the ensuring-release direction by the second locking part 52*a*, when the position ensuring member 40 is at the fitting ensured position. The protrusion 51$b_1$ includes: a locked part (referred to as "first locked part" hereinafter) 51$b_{11}$ that is locked with the first locking part 51*a* when the position ensuring member 40 is at the standby position; and a locked part (referred to as "second locked part" hereinafter) 51$b_{12}$ that is locked with the second locking part 52*a* when the position ensuring member 40 is at the fitting ensured position (FIG. 13, FIG. 16, FIG. 17, and FIG. 19). The first locked part 51$b_{11}$ is disposed to oppose to the first locking part 51*a* on the position operation direction side of the position ensuring member 40, when the protrusion 51$b_1$ is inserted in the first space part 13$b_1$. The second locked part 51$b_{12}$ is disposed to oppose to the second locking part 52*a* on the ensuring-release direction side of the position ensuring member 40, when the protrusion 51$b_1$ is inserted in the second space part 13$b_2$.

Furthermore, with its flexibility, the flexible part 51$b_2$ discussed herein is capable of inserting and removing the protrusion 51$b_1$ to/from the second space part 13$b_2$ in the protrusion insertion direction and in the protrusion removal direction, when the position ensuring member 40 is at the fitting ensured position. The flexible part 51$b_2$ is formed to flex when an external input to the free end exceeds a minimum input value defined on design.

Note here that each of the first locking part 51*a* and the first locked part 51$b_{11}$ discussed herein as an example is formed as a tilted face (referred to as "locking tilted face" hereinafter) that generates force in the protrusion insertion direction based on force applied to the first locked part 51$b_{11}$ from the first locking part 51*a* due to the move of the position ensuring member 40 at the standby position in the ensuring-operation direction. That is, when the first locking part 51*a* receives a pressure force from the first locked part 51$b_{11}$ due to the move of the position ensuring member 40 at the standby position in the ensuring-operation direction and the first locked part 51$b_{11}$ receives a reaction force of the pressure force from the first locking part 51*a*, each of the first locking part 51*a* and the first locked part 51$b_{11}$ discussed herein as an example is formed as the locking tilted face that generates the force in the protrusion insertion direction based on the reaction force. Thereby, in the first locking mechanism 51, even if the position ensuring member 40 at the standby position is pushed and moved to the ensuring-operation direction, the protrusion 51$b_1$ remains inside the first space part 13$b_1$ so that the locked state of the first locking part 51*a* and the first locked part 51$b_{11}$ can be maintained.

Figure 16:
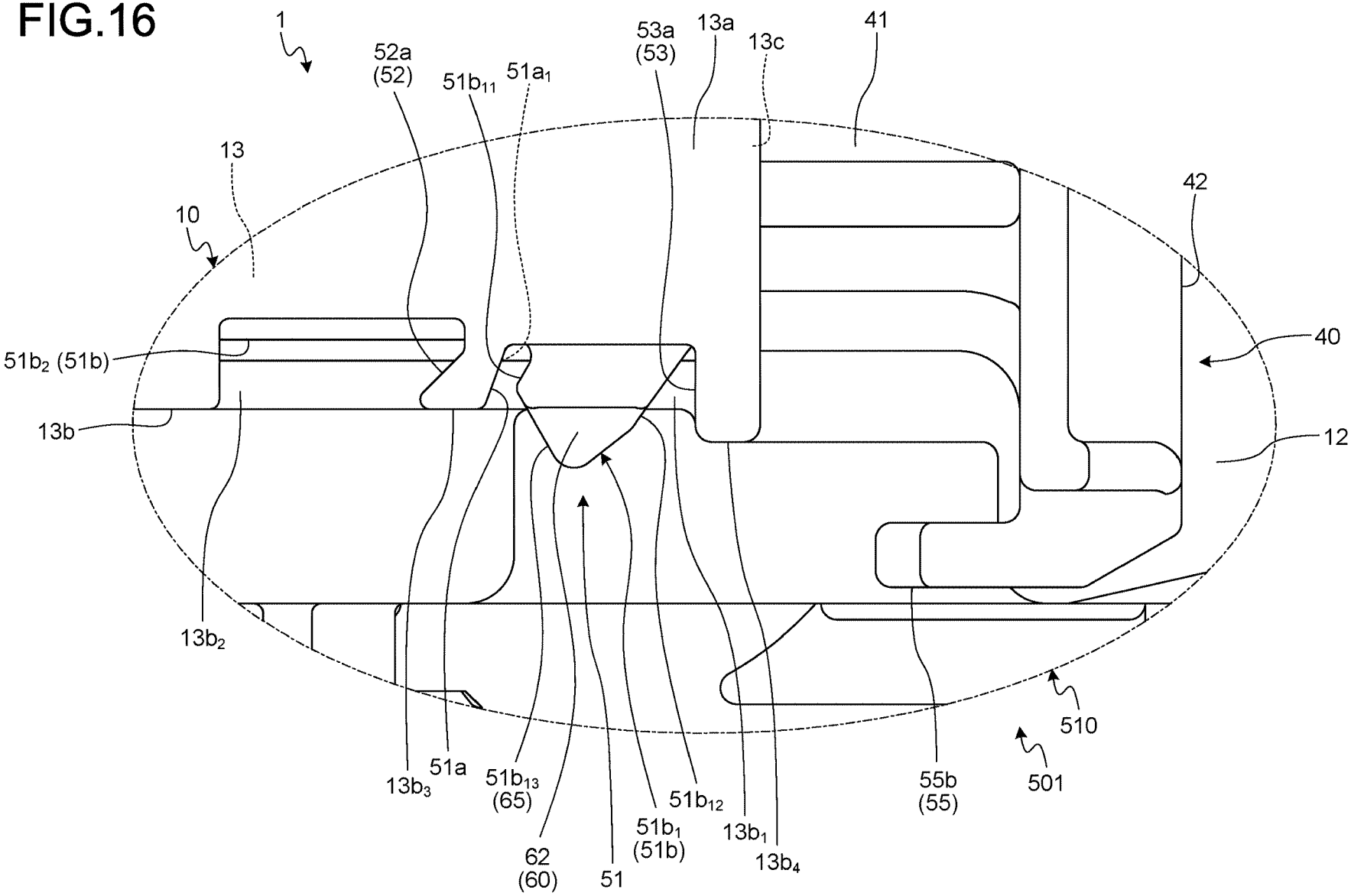
FIG. 16 is an enlarged view of an A-part in FIG. 3.
Figure 17:
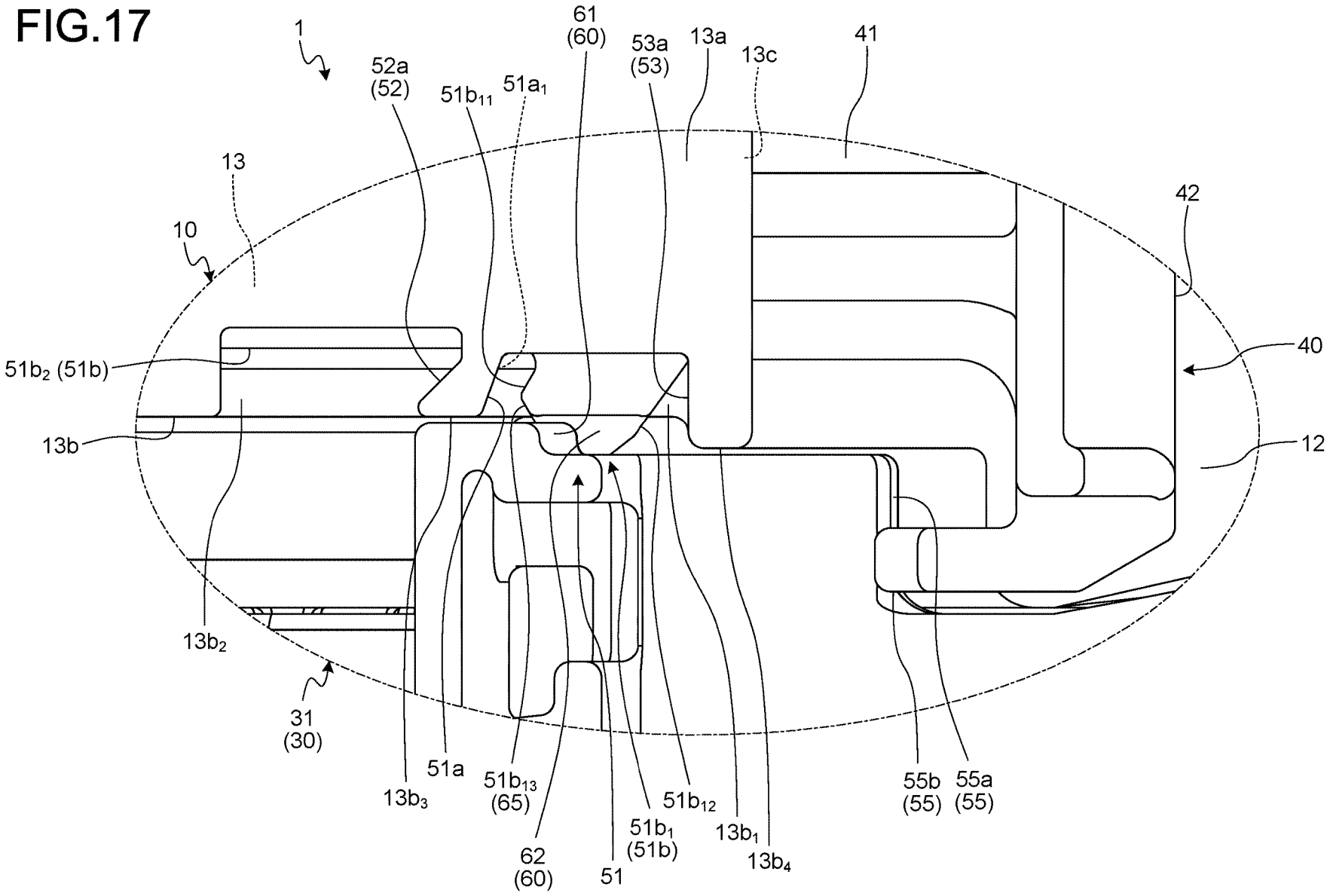
FIG. 17 is an enlarged view of the A-part in FIG. 5.
Figure 18:
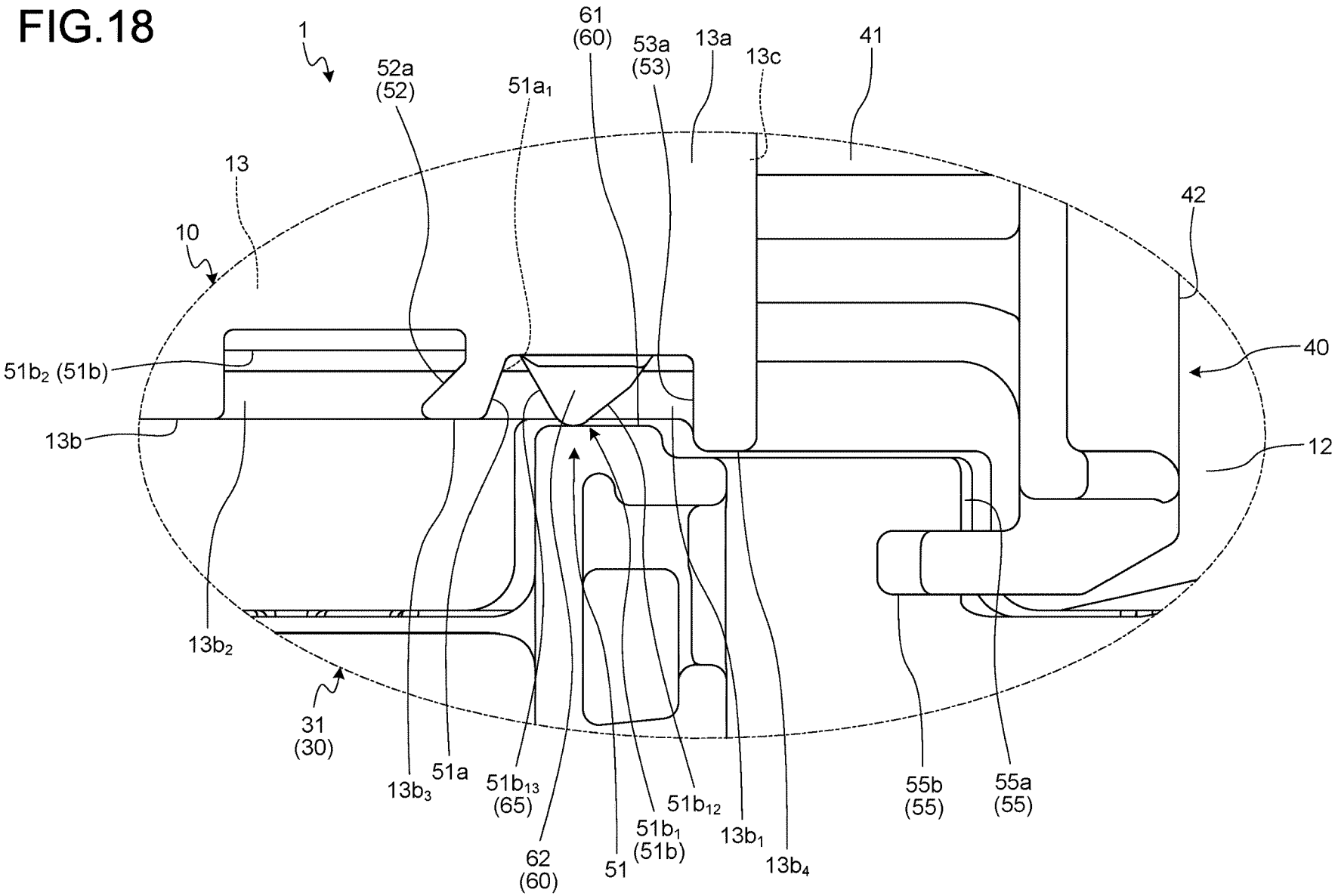
FIG. 18 is an enlarged view of the A-part in FIG. 7.

Between the housing 10 and the position ensuring member 40, provided is a third locking mechanism 53 that locks the move of the position ensuring member 40 at the standby position in the ensuring-release direction when the lever member 30 is not at the completely fitted position, so that the position ensuring member 40 at the standby position when the lever member 30 is not at the completely fitted position does not come off from the opening 13*c* (FIG. 16 to FIG. 18). The third locking mechanism 53 is provided between one of the sidewall parts 13*b* of the housing 10 and the position ensuring member 40, and between the other sidewall part 13*b* of the housing 10 and the position ensuring member 40, respectively.

The third locking mechanism 53 includes a locking part (referred to as "third locking part" hereinafter) 53*a* that is provided to the housing 10 (FIG. 16 to FIG. 18). In the third locking mechanism 53, the wall face of the second wall body 13$b_4$ on the first space part 13$b_1$ side is used as the third locking part 53*a*. When the position ensuring member 40 is at the standby position, the third locking mechanism 53 restricts the move of the position ensuring member 40 at the standby position in the ensuring-release direction by disposing the third locking part 53*a* and the locked body of the position ensuring member 40 to be in a lockable state. As for the third locking mechanism 53, the position ensuring member 40 may include a locked body exclusively for the third locking mechanism 53. Note, however, that the first locked body 51*b* is used in common herein by the first locking mechanism 51, the second locking mechanism 52, and the third locking mechanism 53. In the third locking mechanism 53 discussed herein, the second locked part 51$b_{12}$ of the first locked body 51*b* is locked with the third locking part 53*a* (FIG. 16 to FIG. 18).

The protrusion 51$b_1$ of the first locked body 51*b* discussed herein is disposed to oppose to the third locking part 53*a* in the first space part 13$b_1$ on the ensuring-operation direction side for locking the move of the position ensuring member 40 in the ensuring-release direction by the third locking part 53*a*, when the position ensuring member 40 is at the standby position. The protrusion 51$b_1$ discussed herein locks the second locked part 51$b_{12}$ with the third locking part 53*a* when the position ensuring member 40 is at the standby position. However, as will be described later, the locked state of the second locked part 51$b_{12}$ and the third locking part 53*a* is released by applying force of equal to or more than a prescribed value in the ensuring-release direction on the position ensuring member 40. Thus, separately from the third locking mechanism 53, provided between the housing 10 and the position ensuring member 40 is a fourth locking mechanism 54 that locks the move of the position ensuring member 40 at the standby position in the ensuring-release direction when the lever member 30 is not at the completely fitted position (FIG. 11 and FIG. 15).

Figure 15:
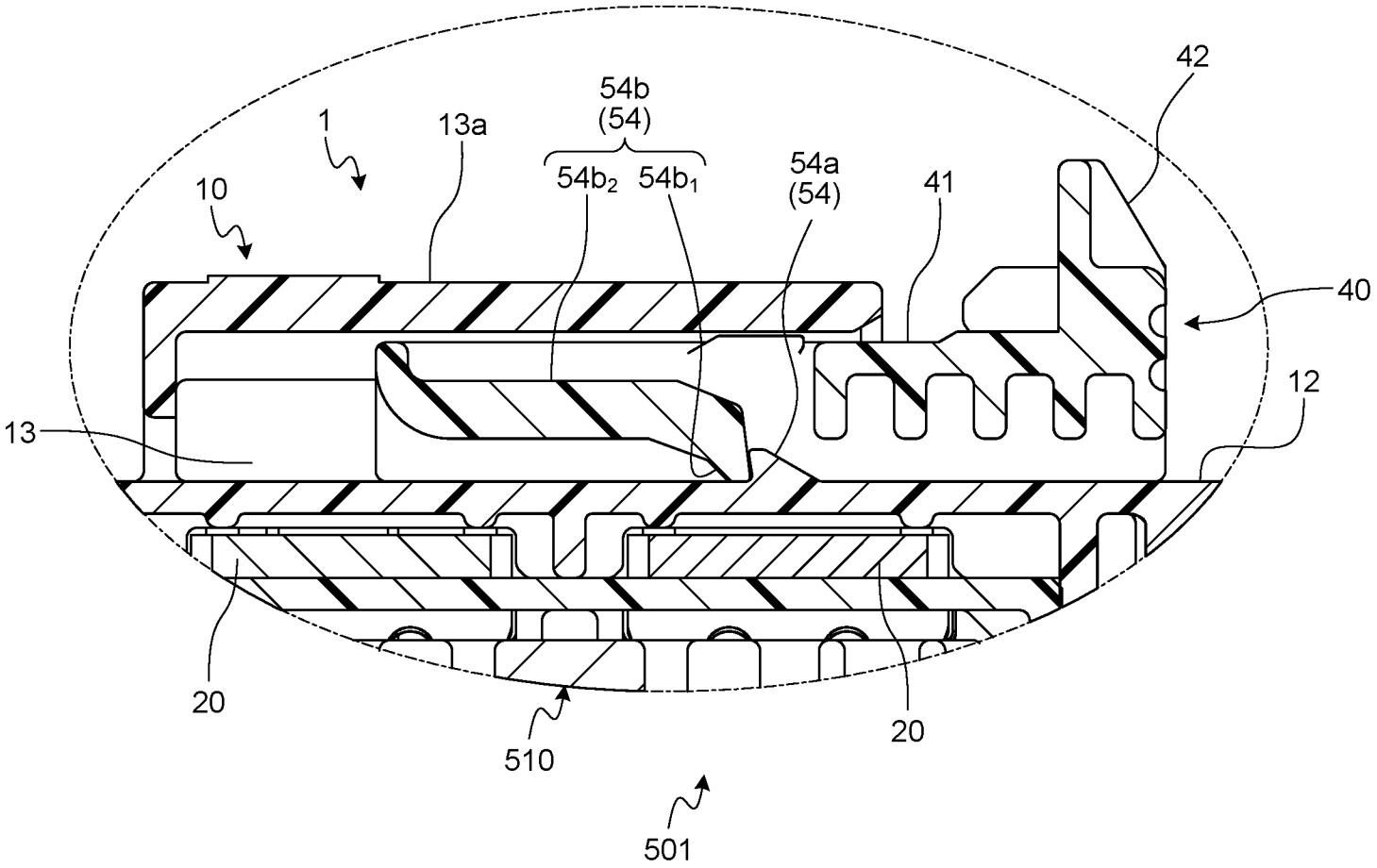
FIG. 15 is a fragmentary enlarged view of a section taken along a line X2-X2 in FIG. 7.

The fourth locking mechanism 54 includes: a locking part (referred to as "fourth locking part" hereinafter) 54*a* that is provided to the housing 10; and a locked body (referred to as "second locked body" hereinafter) 54*b* that is provided to the position ensuring member 40 (FIG. 15). When the position ensuring member 40 is at the standby position, the fourth locking mechanism 54 restricts the move of the position ensuring member 40 at the standby position in the ensuring-release direction by disposing the fourth locking part 54*a* and the second locked body 54*b* to be in a lockable state.

The fourth locking part 54*a* discussed herein is formed as a claw-shaped protrusion that is protruded from the outer wall face of the closing part 12 of the housing 10. Meanwhile, the second locked body 54*b* discussed herein includes: a protrusion 54$b_1$ that is disposed to oppose to the fourth locking part 54*a* on the ensuring-operation direction side for locking the move of the position ensuring member 40 in the ensuring-release direction by the fourth locking part 54*a* when the position ensuring member 40 is at the standby position; and a cantilever flexible part 54$b_2$ that has the protrusion 54$b_1$ provided at its free end, and exhibits flexibility capable of allowing the free end to be displaced between a state where the protrusion 54$b_1$ is disposed to oppose to the fourth locking part 54*a* and a state where those are not disposed in an opposing manner when the position ensuring member 40 is at the standby position (FIG. 15).

In the example discussed herein, the operation part 42 is abutted against the peripheral edge of the opening 13*c* of the housing 10 when the position ensuring member 40 is at the fitting ensured position so as to lock the move of the position ensuring member 40 at the fitting ensured position in the ensuring-operation direction.

Furthermore, provided between the lever member 30 and the position ensuring member 40 is a locking release mechanism 60 that releases the locked state of the position ensuring member 40 with the first locking mechanism 51 when the lever member 30 comes at the completely fitted position, by associating a release operation of the locked state of the position ensuring member 40 with the first locking mechanism 51 with the first rotational operation of the lever member 30 (FIG. 1 to FIG. 5, FIG. 12, FIG. 13, FIG. 17, and FIG. 18). That is, with the lever-type connector 1, the first rotational operation of the lever member 30 is performed to release the locked state of the position ensuring member 40 with the first locking mechanism 51. The locking release mechanism 60 is provided between one of the arms 31 of the lever member 30 and the position ensuring member 40 and between the other arm 31 of the lever member 30 and the position ensuring member 40, respectively.

The locking release mechanism 60 includes: a pushing part 61 that is provided to the lever member 30 to and push and move the protrusion 51$b_1$ toward the protrusion removal direction in association with the first rotational operation of the lever member 30; and a pushed part 62 that is provided to the protrusion 51$b_1$ to receive the force from the pushing part 61 (FIG. 1, FIG. 5, FIG. 17, and FIG. 18).

The pushing part 61 is provided in a protruded state in each of the arms 31 (FIG. 1, FIG. 2, FIG. 4, FIG. 5, FIG. 12, FIG. 17, and FIG. 18). Meanwhile, the pushed part 62 is formed as a tilted face (referred to as "locking-release tilted face" hereinafter) that generates force in the protrusion removal direction based on the force received from the pushing part 61 by the first rotational operation of the lever member 30, and releases the locked state of the first locked part 51$b_{11}$ with the first locking part 51*a* when the lever member 30 comes at the completely fitted position (FIG. 1, FIG. 13, FIG. 16, FIG. 17, and FIG. 18). The locking-release tilted face formed by the pushed part 62 is formed to elastically deform the flexible part 51$b_2$ with the force in the protrusion removal direction when the force in the protrusion removal direction generated by itself exceeds the minimum input value at the free end of the flexible part 51$b_2$, and to release the locked state of the first locked part 51$b_{11}$ with the first locking part 51*a* when the lever member 30 comes at the completely fitted position. That is, with the locking release mechanism 60, the pushing part 61 pushes and moves the protrusion 51$b_1$ toward the protrusion removal direction in association with the first rotational operation of the lever member 30, and the locked state (oppositely disposed state) of the first locking part 51*a* and the first locked part 51$b_{11}$ is released when the lever member 30 comes at the completely fitted position so that the protrusion 51$b_1$ reaches the position at which the position ensuring member 40 at the standby position can be relatively moved to the fitting ensured position.

As for the first wall body 13$b_3$ of the housing 10 and the protrusion 51$b_1$ of the position ensuring member 40, the protrusion 51$b_1$ may be formed to come off from the first space part 13$b_1$, when the locked state of the first locking part 51*a* and the first locked part 51$b_{11}$ is released by the locking release mechanism 60. In that case, with the lever-type connector 1, through releasing the locked state of the first locking part 51*a* and the first locked part 51$b_{11}$ by the locking release mechanism 60, the position ensuring member 40 at the standby position can be relatively moved to the fitting ensured position. In that case, however, when an operator pushes and moves the position ensuring member 40 to the fitting ensured position by fingers, for example, it is difficult to perceive whether the position ensuring member 40 has reached the fitting ensured position. Therefore, with the lever-type connector 1 discussed herein is designed to give a sense of operation when the operator pushes and moves the position ensuring member 40 at the standby position to the fitting ensured position for making it easy to perceive whether the position ensuring member 40 has reached the fitting ensured position.

With the lever-type connector 1, even after the locked state of the first locking part 51*a* and the first locked part 51$b_{11}$ is released by the locking release mechanism 60, the protrusion 51$b_1$ is remained inside the first space part 13$b_1$ to be disposed to oppose to the first locking part 51*a*. Therefore, separately from the locking release mechanism (first locking release mechanism) 60, the lever-type connector 1 is also provided with a locking release mechanism (referred to as "second locking release mechanism" hereinafter) 65 that releases the locked state of the first locking part 51*a* and the protrusion 51$b_1$ after the locked state of the first locking part 51*a* and the first locked part 51$b_{11}$ is released by the first locking release mechanism 60 (FIG. 13, and FIG. 16 to FIG. 18).

Specifically, in the protrusion 51$b_1$, provided is a locking release part 51$b_{13}$ that is disposed to oppose to an end part 51$a_1$ of the first locking part 51*a* on the protrusion removal direction side in the first space part 13$b_1$ on the ensuring-release direction side, when the position ensuring member 40 is at the standby position and the lever member 30 is at the completely fitted position (FIG. 13, and FIG. 16 to FIG. 18). The second locking release mechanism 65 is configured with the end part 51$a_1$ of the first locking part 51*a* and the locking release part 51$b_{13}$ of the protrusion 51$b_1$.

The locking release part 51$b_{13}$ is formed as a locking-release tilted face that generates force in the protrusion removal direction based on force received from the end part 51$a_1$ of the first locking part 51*a* by the move of the position ensuring member 40 at the standby position in the ensuring-operation direction, and removes the protrusion 51$b_1$ from the first space part 13$b_1$. That is, the locking release part 51$b_{13}$ is formed as the locking-release tilted face that generates the force in the protrusion removal direction based on a reaction force that is received from the end part 51$a_1$ when a pressure force is applied to the end part 51$a_1$ of the first locking part 51*a* by the move of the position ensuring member 40 at the standby position in the ensuring-operation direction, and removes the protrusion 51$b_1$ from the first space part 13$b_1$. The locking-release tilted face configured with the locking release part 51$b_{13}$ is formed in a shape that removes the protrusion 51$b_1$ from the first space part 13$b_1$ while elastically deforming the flexible part 51$b_2$ by the force in the protrusion removal direction, when the force in the protrusion removal direction generated by itself exceeds the minimum input value at the free end of the flexible part 51$b_2$.

Therefore, with the lever-type connector 1 discussed herein, when the operator pushes and moves the position ensuring member 40 at the standby position toward the fitting ensured position, the end part $\mathbf{51}a_1$ of the first locking part 51*a* and the locking release part $\mathbf{51}b_{13}$ abut against each other so that the operator first perceives resistance. Furthermore, with the lever-type connector 1 discussed herein, when the operator continues to push and move the position ensuring member 40, the resistance caused by the frictional resistance and the like between the end part $\mathbf{51}a_1$ of the first locking part 51*a* and the locking release part $\mathbf{51}b_{13}$ is perceived by the operator. Furthermore, with the lever-type connector 1 discussed herein, when the operator continues to push and move the position ensuring member 40 and releases the locked state between the end part $\mathbf{51}a_1$ of the first locking part 51*a* and the locking release part $\mathbf{51}b_{13}$, the protrusion $\mathbf{51}b_1$ goes over the first wall body $\mathbf{13}b_3$ and enters into the second space part $\mathbf{13}b_2$, and the position ensuring member 40 reaches the fitting ensured position. Therefore, with the lever-type connector 1, the operator perceives a sense of loss of the pressing force when the protrusion $\mathbf{51}b_1$ goes over the first wall body $\mathbf{13}b_3$ and enters into the second space part $\mathbf{13}b_2$. As described, with the lever-type connector 1 discussed herein, when the operator pushes and moves the position ensuring member 40 at the standby position to the fitting ensured position, it is possible to allow the operator to perceive a sense of operation such as the resistance. Therefore, the operator can easily perceive whether the position ensuring member 40 has reached the fitting ensured position.

As for the protrusion $\mathbf{51}b_1$ discussed herein, the first locked part $\mathbf{51}b_{11}$ and the locking release part $\mathbf{51}b_{13}$ form a protruded mountain-like shape toward the first locking part 51*a* side within the first space part $\mathbf{13}b_1$.

Between the lever member 30 and the position ensuring member 40 discussed herein, provided is a fifth locking mechanism 55 that locks the move of the position ensuring member 40 at the standby position in the ensuring-operation direction from a point where the pushing part 61 of the locking release mechanism 60 abuts against the pushed part 62 of the protrusion $\mathbf{51}b_1$ by the first rotational operation of the lever member 30 until a point where the lever member 30 comes at the completely fitted position (FIG. 4, FIG. 12, FIG. 13, FIG. 17, FIG. 18, and FIG. 20). The fifth locking mechanism 55 includes: a locking part 55*a* for the time of rotational operation provided in a protruded state to the pushing part 61 of the lever member 30 (FIG. 4, FIG. 12, FIG. 17, FIG. 18, and FIG. 20); and a locked part 55*b* for the time of rotational operation provided in a protruded state to the operation part 42 of the position ensuring member 40 (FIG. 4, FIG. 13, FIG. 17, FIG. 18, and FIG. 20). As for the fifth locking mechanism 55, the locked part 55*b* is disposed to oppose to the locking part 55*a* on the ensuring-operation direction side from the point where the pushing part 61 of the locking release mechanism 60 abuts against the pushed part 62 of the protrusion $\mathbf{51}b_1$ by the first rotational operation of the lever member 30 until the point where the lever member 30 comes at the completely fitted position. Then, when the lever member 30 comes at the completely fitted position, the fifth locking mechanism 55 releases the locked state (oppositely disposed state) of the locking part 55*a* and the locked part 55*b*.

Figure 19:
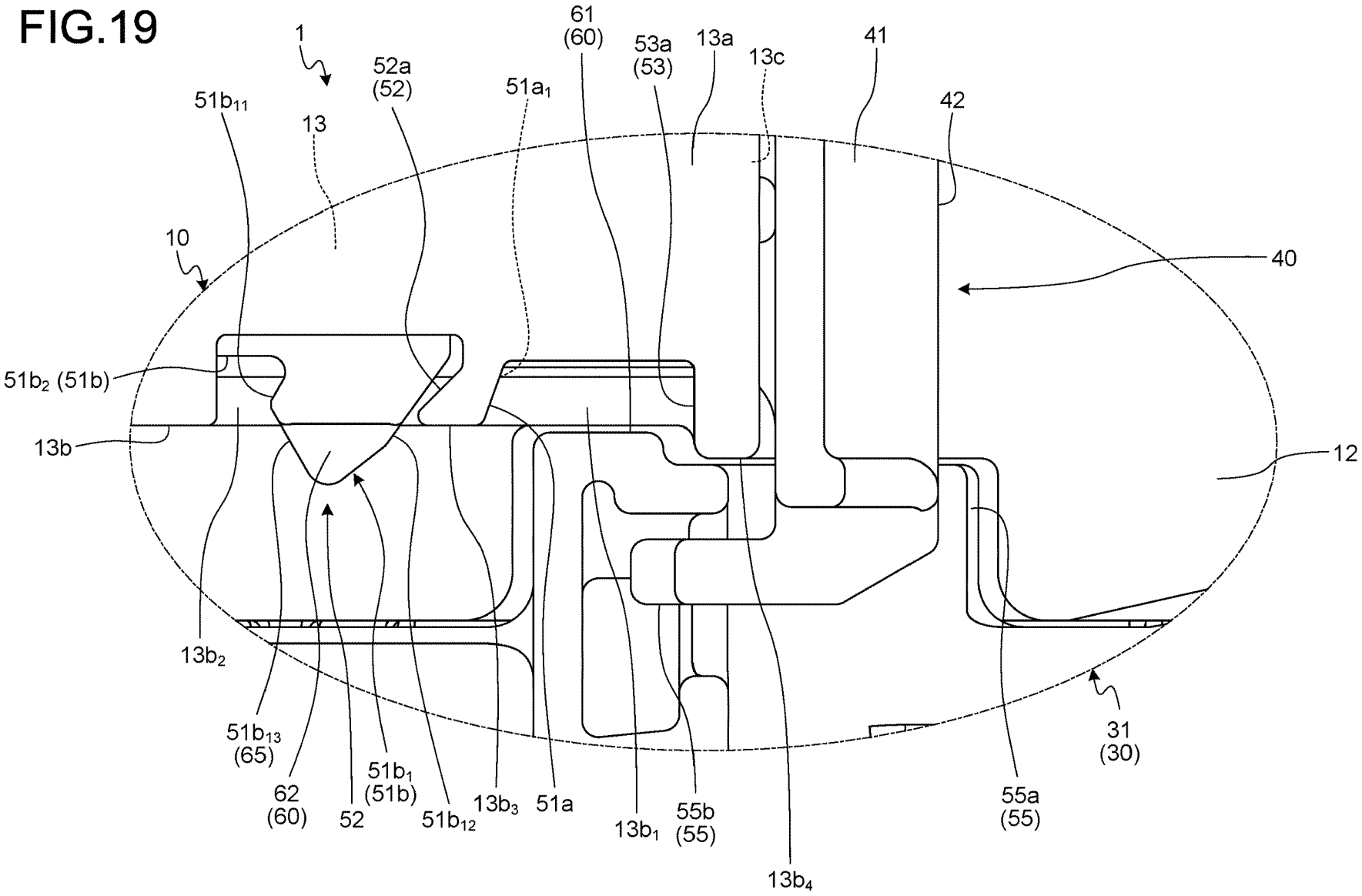
FIG. 19 is an enlarged view of the A-part in FIG. 9.
Figure 20:
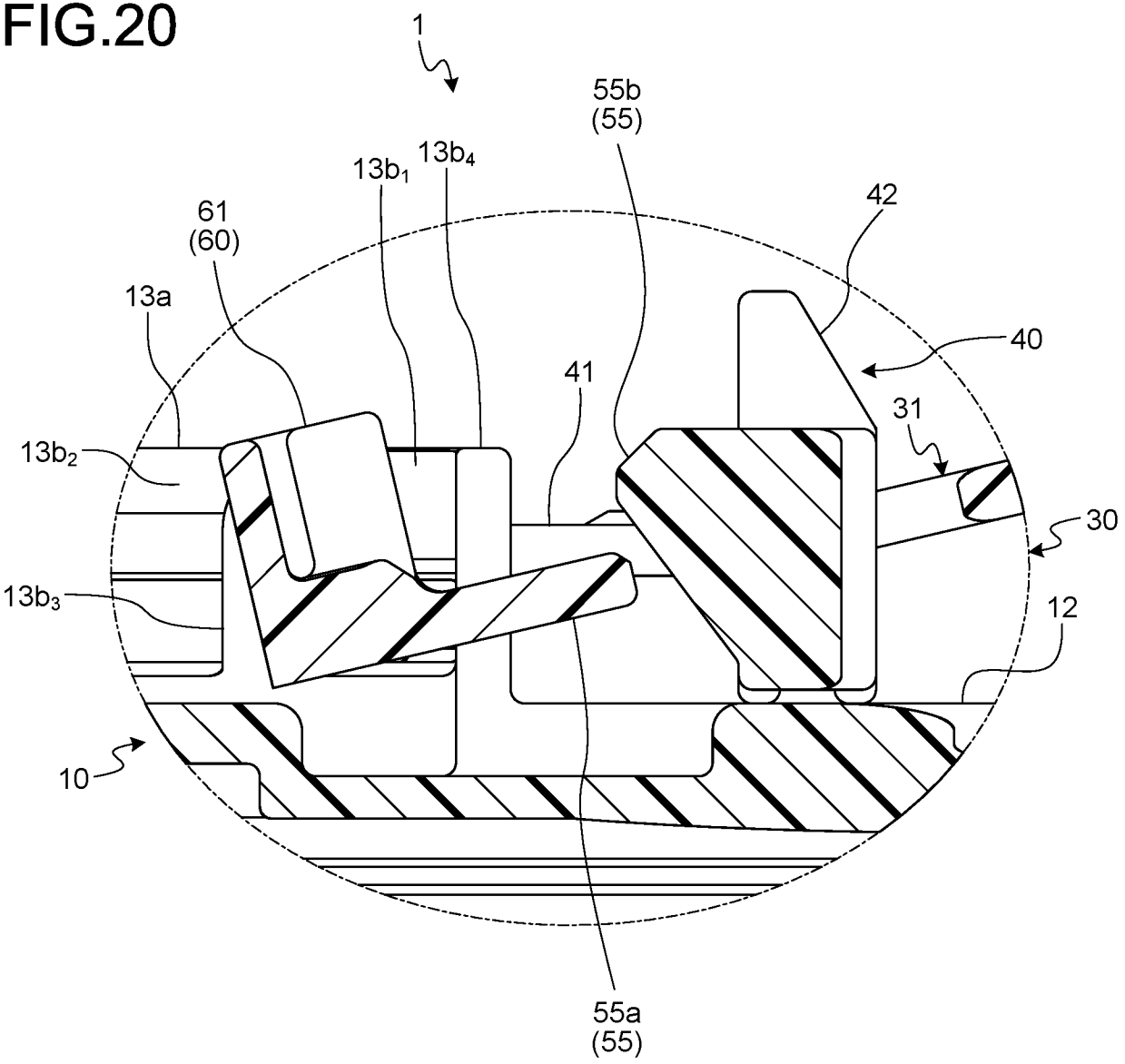
FIG. 20 is a fragmentary enlarged view of a section taken along a line X3-X3 in FIG. 5.

With the lever-type connector 1, when performing the second rotational operation of the lever member 30 from the completely fitted position toward the temporarily fitted position, the position ensuring member 40 at the fitting ensured position is relatively moved to the standby position before performing the second rotational operation. For that, it is necessary to release the locked state of the position ensuring member 40 with the second locking mechanism 52. Therefore, the second locked part $\mathbf{51}b_{12}$ of the protrusion $\mathbf{51}b_1$ in the position ensuring member 40 is formed as a locking-release tilted face that generates force in the protrusion removal direction based on force received from the second locking part 52*a* due to the move of the position ensuring member 40 at the fitting ensured position in the ensuring-release direction (FIG. 19). That is, the second locked part $\mathbf{51}b_{12}$ is formed as the locking-release tilted face that generates the force in the protrusion removal direction based on a reaction force that is received from the second locking part 52*a* when a pressure force is applied to the second locking part 52*a* by the move of the position ensuring member 40 at the fitting ensured position in the ensuring-release direction, and removes the protrusion $\mathbf{51}b_1$ from the second space part $\mathbf{13}b_2$.

The locking-release tilted face configured with the second locked part $\mathbf{51}b_{12}$ discussed herein is formed in a shape that removes the protrusion $\mathbf{51}b_1$ from the second space part $\mathbf{13}b_2$ while elastically deforming the flexible part $\mathbf{51}b_2$ by the force in the protrusion removal direction, when the force in the protrusion removal direction generated by itself exceeds the minimum input value at the free end of the flexible part $\mathbf{51}b_2$. Thus, the second locked part $\mathbf{51}b_{12}$ cannot elastically deform the flexible part $\mathbf{51}b_2$ until the force in the protrusion removal direction generated by itself exceeds the minimum input value at the free end of the flexible part $\mathbf{51}b_2$. Therefore, with the lever-type connector 1, the locked state by the second locking part 52*a* and the second locked part $\mathbf{51}b_{12}$ is maintained until the force in the protrusion removal direction exceeds the minimum input value at the free end of the flexible part $\mathbf{51}b_2$. The second locking part 52*a* herein is also formed as a tilted face configured with a slope similar to that of the second locked part $\mathbf{51}b_{12}$.

As described above, the lever-type connector 1 according to the embodiment is capable of fully fitting the fitting part 11 of the housing 10 to the counterpart fitting part 511 and releasing the locked state of the position ensuring member 40 at the standby position with the first locking mechanism 51 by performing the first rotational operation of the lever member 30. That is, the lever-type connector 1 is capable of performing a fitting/connecting operation to the counterpart fitting part 511 and a release operation of the locked state of the position ensuring member 40 at the standby position performed after the fitting/connecting operation by one operation performed on the lever member 30. Therefore, the lever-type connector 1 is excellent in the operability when fitted/connected to the mating connector 501, so that it is considered suitable for the fitting/connecting work.

Furthermore, in the lever-type connector 1 according to the embodiment, the first locking mechanism 51 for keeping the position ensuring member 40 at the standby position in that state until the lever member 30 comes at the completely fitted position, and the second locking release mechanism 65 related to a sense of operation perceived when the operator pushes and moves the position ensuring member 40 at the standby position to the fitting ensured position are configured with the first wall body $\mathbf{13}b_3$ of the housing 10 and the protrusion $\mathbf{51}b_1$ of the position ensuring member 40 to concentrate structural elements related to the respective functions in one place. Therefore, it is unnecessary with the lever-type connector 1 to separately provide the wall bodies and protrusions for the first locking mechanism 51 and the second locking release mechanism 65, so that the size of the body thereof can be minimized.

The lever-type connector according to the present embodiment is capable of fully fitting the fitting part of the housing to the counterpart fitting part and releasing the locked state of the position ensuring member at the standby position with the first locking mechanism by performing the first rotational operation of the lever member. That is, the lever-type connector enables performing the fitting/connecting operation to the counterpart fitting part and the release operation of the locked state of the position ensuring member at the standby position performed after the fitting/connecting operation by one operation performed on the lever member. Therefore, the lever-type connector is excellent in the operability when fitted/connected to the mating connector, so that it is considered suitable for the fitting/connecting work.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lever-type connector comprising:

a housing that is relatively movable along connector insertion/removal directions between a temporarily fitted state and a completely fitted state with respect to a counterpart fitting part;

a terminal fitting that is stored in the housing and electrically connected to a counterpart terminal fitting when the housing is in the completely fitted state;

a lever member that is relatively rotatable with respect to the housing between a temporarily fitted position where the housing is in the temporarily fitted state and a completely fitted position where the housing is in the completely fitted state, the lever member relatively moving the housing with respect to the counterpart fitting part from the temporarily fitted state to the completely fitted state by a first rotation operation from the temporarily fitted position toward the completely fitted position, and relatively moving the housing with respect to the counterpart fitting part from the completely fitted state to the temporarily fitted state by a second rotation operation from the completely fitted position toward the temporarily fitted position; and a position ensuring member that is attached to be freely movable with respect to the housing between a fitting ensured position where the housing is in the completely fitted state and a standby position where the housing is not in the completely fitted state, wherein a first locking mechanism and a second locking mechanism are provided between the housing and the position ensuring member, the first locking mechanism is configured to prevent the position ensuring member, at the standby position, from engaging the second locking mechanism by preventing movement of the position ensuring member in a first direction toward the second locking mechanism, the second locking mechanism locking is configured to prevent the position ensuring member, at a fitting assured position, from moving in a second direction opposite to the first direction, a locking release mechanism is provided between the lever member and the position ensuring member, the locking release mechanism releasing a locked state of the position ensuring member with the first locking mechanism when the lever member comes at the completely fitted position by associating a release operation of the locked state of the position ensuring member with the first locking mechanism with the first rotation operation of the lever member, the first locking mechanism includes a locking part provided to the housing, and a locked body provided to the position ensuring member, and the locked body includes a protrusion that is disposed to oppose to the locking part within a space part to prevent the position ensuring member from moving in the first direction by the locking part when the position ensuring member is at the standby position.

2. The lever-type connector according to claim 1, wherein the lever member includes two arms with a rotation fulcrum for the first rotation operation and the second rotation operation, the two arms being disposed to oppose to each other with a space being provided in an axial direction of a rotation shaft for the first rotation operation and the second rotation operation, and an operation part that connects the two arms and functions as a point of application of the first rotation operation and the second rotation operation, each of the first locking mechanism and the second locking mechanism is provided at one of the arms of the lever member at the completely fitted position, another first locking mechanism and another second locking mechanism are provided at another of the arms of the lever member at the completely fitted position, a portion of the locking release mechanism is provided between the one of the arms and the position ensuring member, and another portion of the locking release mechanism is provided between the other of the arms and the position ensuring member.

3. The lever-type connector according to claim 1, wherein the first locking mechanism is configured to allow the fitting position ensuring member to move from the standby position to the fitting assured position by, as the lever member is moved from the temporarily fitted state to the completely fitted state, removing the portion of the lever member from between the position ensuring member and the second locking member.

4. The lever-type connector according to claim 1, wherein the locked body further includes a cantilever flexible part that has the protrusion provided at its free end and exhibits flexibility capable of allowing the free end to be displaced toward a protrusion insertion direction and a protrusion removal direction of the protrusion with respect to the space part when the position ensuring member is at the standby position, the protrusion includes a locked part that is locked with the locking part when the position ensuring member is at the standby position, the locking release mechanism includes a pushing part that is provided to the lever member to push and move the protrusion toward the protrusion removal direction in association with the first rotation operation of the lever member, and a pushed part that is provided to the protrusion to receive force from the pushing part, and the pushed part is formed as a locking-release tilted face and based on force received from the pushing part by the first rotation operation, releases a locked state of the locked part with the locking part when the lever member comes at the completely fitted position.

5. The lever-type connector according to claim 4, wherein the lever member includes two arms with a rotation fulcrum for the first rotation operation and the second rotation operation, the two arms being disposed to oppose to each other with a space being provided in an axial direction of a rotation shaft for the first rotation operation and the second rotation operation, and an operation part that connects the two arms and functions as a point of application of the first rotation operation and the second rotation operation, each of the first locking mechanism and the second locking mechanism is provided at one of the arms of the lever member at the completely fitted position, another first locking mechanism and another second locking mechanism are provided at another of the arms of the lever member at the completely fitted position, a portion of the locking release mechanism is provided between the one of the arms and the position ensuring member, and another portion of the locking release mechanism is provided between the other of the arms and the position ensuring member.

6. The lever-type connector according to claim 4, wherein the protrusion includes a locking release part that is disposed to oppose to an end part of the locking part, when the position ensuring member is at the standby position and the lever member is at the completely fitted position, and the locking release part is formed as a locking-release tilted face that generates force in the protrusion removal direction based on force that is received from the end part of the locking part due to the move of the position ensuring member at the standby position in the first direction, and removes the protrusion from the space part.

7. The lever-type connector according to claim 6, wherein the lever member includes two arms with a rotation fulcrum for the first rotation operation and the second rotation operation, the two arms being disposed to oppose to each other with a space being provided in an axial direction of a rotation shaft for the first rotation operation and the second rotation operation, and an operation part that connects the two arms and functions as a point of application of the first rotation operation and the second rotation operation, each of the first locking mechanism and the second locking mechanism is provided at one of the arms of the lever member at the completely fitted position, another first locking mechanism and another second locking mechanism are provided at another of the arms of the lever member at the completely fitted position, a portion of the locking release mechanism is provided between the one of the arms and the position ensuring member, and another portion of the locking release mechanism is provided between the other of the arms and the position ensuring member.

8. The lever-type connector according to claim 4, wherein each of the locking part and the locked part is formed as a locking tilted face that generates force in the protrusion insertion direction based on force that is applied to the locked part from the locking part caused due to the move of the position ensuring member at the standby position in the first direction.

9. The lever-type connector according to claim 8, wherein the lever member includes two arms with a rotation fulcrum for the first rotation operation and the second rotation operation, the two arms being disposed to oppose to each other with a space being provided in an axial direction of a rotation shaft for the first rotation operation and the second rotation operation, and an operation part that connects the two arms and functions as a point of application of the first rotation operation and the second rotation operation, each of the first locking mechanism and the second locking mechanism is provided at one of the arms of the lever member at the completely fitted position, another first locking mechanism and another second locking mechanism are provided at another of the arms of the lever member at the completely fitted position, a portion of the locking release mechanism is provided between the one of the arms and the position ensuring member, and another portion of the locking release mechanism is provided between the other of the arms and the position ensuring member.

10. The lever-type connector according to claim 8, wherein the protrusion includes a locking release part that is disposed to oppose to an end part of the locking part, when the position ensuring member is at the standby position and the lever member is at the completely fitted position, and the locking release part is formed as a locking-release tilted face that generates force in the protrusion removal direction based on force that is received from the end part of the locking part due to the move of the position ensuring member at the standby position in first direction, and removes the protrusion from the space part.

11. The lever-type connector according to claim 10, wherein the lever member includes two arms with a rotation fulcrum for the first rotation operation and the second rotation operation, the two arms being disposed to oppose to each other with a space being provided in an axial direction of a rotation shaft for the first rotation operation and the second rotation operation, and an operation part that connects the two arms and functions as a point of application of the first rotation operation and the second rotation operation, each of the first locking mechanism and the second locking mechanism is provided at one of the arms of the lever member at the completely fitted position, another first locking mechanism and another second locking mechanism are provided at another of the arms of the lever member at the completely fitted position, a portion of the locking release mechanism is provided between the one of the arms and the position ensuring member, and another portion of the locking release mechanism is provided between the other of the arms and the position ensuring member.

12. A lever-type connector comprising:

a housing that is relatively movable along connector insertion/removal directions between a temporarily fitted state and a completely fitted state with respect to a counterpart fitting part;

a terminal fitting that is stored in the housing and electrically connected to a counterpart terminal fitting when the housing is in the completely fitted state;

a lever member that is relatively rotatable with respect to the housing between a temporarily fitted position where the housing is in the temporarily fitted state and a completely fitted position where the housing is in the completely fitted state, the lever member relatively moving the housing with respect to the counterpart fitting part from the temporarily fitted state to the completely fitted state by a first rotation operation from the temporarily fitted position toward the completely fitted position, and relatively moving the housing with respect to the counterpart fitting part from the completely fitted state to the temporarily fitted state by a second rotation operation from the completely fitted position toward the temporarily fitted position; and a position ensuring member that is attached to be freely movable with respect to the housing between a fitting ensured position where the housing is in the completely fitted state and a standby position where the housing is not in the completely fitted state, wherein a first locking mechanism and a second locking mechanism are provided between the housing and the position ensuring member, the first locking mechanism is configured to prevent the position ensuring member, at the standby position, from engaging the second locking mechanism by preventing movement of the position ensuring member in a first direction toward the second locking mechanism, the second locking mechanism locking is configured to prevent the position ensuring member, at a fitting assured position, from moving in a second direction opposite to the first direction, a locking release mechanism is provided between the lever member and the position ensuring member, the locking release mechanism releasing a locked state of the position ensuring member with the first locking mechanism when the lever member comes at the completely fitted position by associating a release operation of the locked state of the position ensuring member with the first locking mechanism with the first rotation operation of the lever member, the first locking mechanism includes a locking part provided to the housing, and a locked body provided to the position ensuring member, the locked body includes a protrusion that is disposed to oppose to the locking part within a space part to prevent the position ensuring member from moving in the first direction by the locking part when the position ensuring member is at the standby position, and a cantilever flexible part that has the protrusion provided at its free end and exhibits flexibility capable of allowing the free end to be displaced toward a protrusion insertion direction and a protrusion removal direction of the protrusion with respect to the space part when the position ensuring member is at the standby position, the protrusion includes a locked part that is locked with the locking part when the position ensuring member is at the standby position, the locking release mechanism includes a pushing part that is provided to the lever member to push and move the protrusion toward the protrusion removal direction in association with the first rotation operation of the lever member, and a pushed part that is provided to the protrusion to receive force from the pushing part, and the pushed part is formed as a locking-release tilted face, and based on force received from the pushing part by the first rotation operation, releases a locked state of the locked part with the locking part when the lever member comes at the completely fitted position.

* * * * *